US008651400B2

(12) United States Patent
Walker et al.

(10) Patent No.: US 8,651,400 B2
(45) Date of Patent: Feb. 18, 2014

(54) VARIABLE ARC NOZZLE

(75) Inventors: Samuel C. Walker, Green Valley, AZ (US); Steven D. Geerligs, Vail, AZ (US)

(73) Assignee: Rain Bird Corporation, Azusa, CA (US)

( * ) Notice: Subject to any disclaimer, the term of this patent is extended or adjusted under 35 U.S.C. 154(b) by 887 days.

(21) Appl. No.: 12/686,895

(22) Filed: Jan. 13, 2010

(65) Prior Publication Data

US 2010/0108787 A1 May 6, 2010

Related U.S. Application Data

(63) Continuation-in-part of application No. 11/622,772, filed on Jan. 12, 2007, now Pat. No. 7,703,706.

(51) Int. Cl.

| | |
|---|---|
| ***B05B 1/32*** | (2006.01) |
| ***B05B 1/34*** | (2006.01) |
| ***B05B 3/02*** | (2006.01) |

(52) U.S. Cl.

USPC ..... 239/484; 239/222.11; 239/456; 239/460; 239/482; 239/483; 239/487

(58) Field of Classification Search

USPC ..... 239/97, 98, 214.11, 218.5, 222.11, 246, 239/451, 452, 456, 457, 458, 460, 461, 484, 239/487, 501, 505, 518, DIG. 1, 482, 483

See application file for complete search history.

(56) References Cited

U.S. PATENT DOCUMENTS

| | | | |
|---|---|---|---|
| 458,607 | A | 9/1891 | Weiss |
| 1,523,609 | A | 1/1922 | Roach |
| 1,432,386 | A | 10/1922 | Curney |
| 2,075,589 | A | 4/1933 | Munz |
| 2,130,810 | A | 9/1938 | Munz |
| 2,348,776 | A | 4/1941 | Bentley |
| 2,634,163 | A | 4/1953 | Double |
| 2,723,879 | A | 11/1955 | Martin |

(Continued)

FOREIGN PATENT DOCUMENTS

| | | |
|---|---|---|
| AU | 783999 | 1/2006 |
| CA | 2427450 | 6/2004 |

(Continued)

OTHER PUBLICATIONS

United States Patent and Trademark Office, May 24, 2013 Office Action in U.S. Appl. No. 12/720,261.

(Continued)

*Primary Examiner* — Ryan Reis

(74) *Attorney, Agent, or Firm* — Fitch, Even, Tabin & Flannery, LLP

(57) ABSTRACT

A variable arc sprinkler nozzle is provided for distribution of water through nearly any adjustable arcuate span. The nozzle includes one or more arcuate slots formed by the helical engagement of spiral surfaces of a deflector and a nozzle body. A user may rotate a portion of the nozzle body to select the arcuate span of the one or more slots. A matched precipitation rate feature is adjustable to proportion the amount of water directed to the deflector depending on the extent of the arcuate span. Further, edge fins on the deflector and nozzle body channel water flow at the two edges of the distribution arc to increase the throw radius and to provide fairly uniform water distribution at the edges of the arc.

20 Claims, 21 Drawing Sheets

(56) References Cited

U.S. PATENT DOCUMENTS 2,785,013 A 3/1957 Stearns
2,935,266 A 6/1958 Coleondro
2,914,257 A 1/1959 Wiant
2,875,783 A 3/1959 Schippers
2,990,123 A 6/1961 Hyde
2,990,128 A 6/1961 Hyde
3,029,030 A * 4/1962 Dey, Sr. ..... 239/520
3,109,591 A 11/1963 Moen
3,940,066 A 2/1976 Hunter
3,948,285 A 4/1976 Flynn
3,955,764 A 5/1976 Phaup
4,026,471 A 5/1977 Hunter
4,119,275 A 10/1978 Hunter
4,131,234 A 12/1978 Pescetto
4,189,099 A 2/1980 Bruninga
4,198,000 A 4/1980 Hunter
4,253,608 A 3/1981 Hunter
4,272,024 A 6/1981 Kah
4,353,506 A 10/1982 Hayes
4,353,507 A 10/1982 Kah
4,398,666 A 8/1983 Hunter
4,417,691 A 11/1983 Lockwood
4,456,181 A 6/1984 Burnham
4,471,908 A 9/1984 Hunter
4,479,611 A 10/1984 Galvis
4,501,391 A 2/1985 Hunter
4,566,632 A 1/1986 Sesser
4,568,024 A 2/1986 Hunter
4,579,284 A 4/1986 Arnold
4,579,285 A 4/1986 Hunter
4,618,100 A 10/1986 White
4,624,412 A 11/1986 Hunter
4,625,917 A 12/1986 Torney
RE32,386 E 3/1987 Hunter
4,660,766 A 4/1987 Nelson
4,669,663 A 6/1987 Meyer
4,676,438 A 6/1987 Sesser
4,681,260 A 7/1987 Cochran
4,681,263 A 7/1987 Cockman
4,699,321 A 10/1987 Bivens
4,708,291 A 11/1987 Grundy
4,718,605 A 1/1988 Hunter
4,720,045 A 1/1988 Meyer
4,739,934 A 4/1988 Gewelber
D296,464 S 6/1988 Marmol et al.
4,752,031 A 6/1988 Merrick
4,763,838 A 8/1988 Holcomb
4,784,325 A 11/1988 Walker
4,796,809 A 1/1989 Hunter
4,796,811 A 1/1989 Davisson
4,815,662 A 3/1989 Hunter
4,834,289 A 5/1989 Hunter
4,836,449 A 6/1989 Hunter
4,836,450 A 6/1989 Hunter
4,840,312 A 6/1989 Tyler
4,842,201 A 6/1989 Hunter
4,867,378 A 9/1989 Kah
4,898,332 A 2/1990 Hunter et al.
4,901,924 A 2/1990 Kah
4,932,590 A 6/1990 Hunter
4,944,456 A 7/1990 Zakai
4,948,052 A 8/1990 Hunter
4,955,542 A 9/1990 Kah
4,961,534 A 10/1990 Tyler
4,967,961 A 11/1990 Hunter
4,971,250 A 11/1990 Hunter
D312,865 S 12/1990 Davisson
4,986,474 A 1/1991 Schisler
5,031,840 A 7/1991 Grundy et al.
5,050,800 A 9/1991 Lamar
5,052,621 A 10/1991 Katzer
5,058,806 A 10/1991 Rupar
5,078,321 A 1/1992 Davis
5,083,709 A * 1/1992 Iwanowski ..... 239/551
RE33,823 E 2/1992 Nelson
5,086,977 A 2/1992 Kah
5,090,619 A 2/1992 Barthold
5,098,021 A 3/1992 Kah
5,104,045 A 4/1992 Kah
5,123,597 A 6/1992 Bendall
5,141,024 A 8/1992 Hicks
5,148,990 A 9/1992 Kah, Jr.
5,148,991 A 9/1992 Kah
5,152,458 A 10/1992 Curtis
5,158,232 A 10/1992 Tyler
5,174,501 A 12/1992 Hadar
5,199,646 A 4/1993 Kah
5,205,491 A 4/1993 Hadar
5,224,653 A 7/1993 Nelson
5,226,599 A 7/1993 Lindermeir
5,226,602 A 7/1993 Cochran
5,234,169 A 8/1993 McKenzie
5,240,182 A 8/1993 Lemme
5,240,184 A 8/1993 Lawson
5,267,689 A 12/1993 Forer
5,288,022 A 2/1994 Sessor
5,299,742 A 4/1994 Han
5,322,223 A 6/1994 Hadar
5,335,857 A 8/1994 Hagon
5,360,167 A 11/1994 Grundy
5,370,311 A 12/1994 Chen
5,372,307 A 12/1994 Sesser
5,375,768 A 12/1994 Clark
5,398,872 A 3/1995 Joubran
5,417,370 A 5/1995 Kah
5,423,486 A 6/1995 Hunter
5,435,490 A 7/1995 Machut
5,439,174 A 8/1995 Sweet
RE35,037 E 9/1995 Kah
5,456,411 A 10/1995 Scott
5,503,139 A 4/1996 McMahon
5,526,982 A 6/1996 McKenzie
5,544,814 A 8/1996 Spenser
5,556,036 A * 9/1996 Chase ..... 239/457
5,588,594 A 12/1996 Kah, Jr.
5,588,595 A 12/1996 Sweet
5,598,977 A 2/1997 Lemme
5,611,488 A 3/1997 Frolich
5,620,141 A 4/1997 Chiang
5,640,983 A 6/1997 Sherman
5,642,861 A * 7/1997 Ogi et al. ..... 239/568
5,653,390 A 8/1997 Kah
5,662,545 A 9/1997 Zimmerman
5,671,885 A 9/1997 Davisson
5,671,886 A 9/1997 Sesser
5,676,315 A 10/1997 Han
D388,502 S 12/1997 Kah
5,695,123 A 12/1997 Le
5,699,962 A 12/1997 Scott
5,711,486 A 1/1998 Clark
5,718,381 A 2/1998 Katzer et al.
5,720,435 A 2/1998 Hunter
5,722,593 A 3/1998 McKenzie
5,758,827 A 6/1998 Van Le
5,762,270 A 6/1998 Kearby
5,765,757 A 6/1998 Bendall
5,765,760 A 6/1998 Kuo
5,769,322 A 6/1998 Smith
5,785,248 A 7/1998 Staylor
5,820,029 A 10/1998 Marans
5,823,439 A 10/1998 Hunter
5,823,440 A 10/1998 Clark
5,826,797 A 10/1998 Kah
5,845,849 A 12/1998 Mitzlaff
5,875,969 A 3/1999 Grundy
5,918,812 A 7/1999 Beutler
5,927,607 A 7/1999 Scott
5,971,297 A 10/1999 Sesser
5,988,523 A 11/1999 Scott
5,992,760 A 11/1999 Kearby
6,007,001 A 12/1999 Hilton
6,019,295 A * 2/2000 McKenzie ..... 239/451
6,029,907 A 2/2000 McKenzie
6,042,021 A 3/2000 Clark

(56) References Cited

U.S. PATENT DOCUMENTS 6,050,502 A 4/2000 Clark
6,076,744 A 6/2000 O'Brien
6,076,747 A 6/2000 Ming-Yuan
6,085,995 A 7/2000 Kah
6,102,308 A 8/2000 Steingrass
6,109,545 A 8/2000 Kah
6,138,924 A 10/2000 Hunter
6,145,758 A * 11/2000 Ogi et al. ..... 239/457
6,155,493 A 12/2000 Kearby
6,158,675 A 12/2000 Ogi
6,182,909 B1 2/2001 Kah
6,186,413 B1 2/2001 Lawson
6,223,999 B1 5/2001 Lemelshtrich
6,227,455 B1 5/2001 Scott
6,230,988 B1 5/2001 Chao
6,230,989 B1 5/2001 Haverstraw
6,237,862 B1 5/2001 Kah
6,241,158 B1 6/2001 Clark
6,244,521 B1 6/2001 Sessor
6,264,117 B1 7/2001 Roman
6,286,767 B1 9/2001 Hui-Chen
6,332,581 B1 12/2001 Chin
6,336,597 B1 1/2002 Kah
6,341,733 B1 1/2002 Sweet
6,345,541 B1 2/2002 Hendey
6,367,708 B1 4/2002 Olson
D458,342 S 6/2002 Johnson
6,443,372 B1 9/2002 Hsu
6,454,186 B2 9/2002 Haverstraw
6,457,656 B1 10/2002 Scott
6,464,151 B1 10/2002 Cordua
6,478,237 B2 11/2002 Kearby
6,488,218 B1 12/2002 Townsend
6,491,235 B1 12/2002 Scott
6,494,384 B1 12/2002 Meyer
6,499,672 B1 12/2002 Sessor
6,530,531 B2 3/2003 Butler
6,601,781 B2 8/2003 Kah
6,607,147 B2 8/2003 Schneider
6,622,940 B2 9/2003 Huang
6,637,672 B2 10/2003 Cordua
6,651,904 B2 11/2003 Roman
6,651,905 B2 11/2003 Sesser et al.
6,688,539 B2 2/2004 Vander Griend
6,695,223 B2 2/2004 Beutler
6,715,699 B1 4/2004 Greenberg
6,719,218 B2 4/2004 Cool
6,732,952 B2 5/2004 Kah
6,736,332 B2 5/2004 Sesser et al.
6,736,336 B2 5/2004 Wong
6,769,633 B1 8/2004 Huang
6,814,304 B2 11/2004 Onofrio
6,814,305 B2 11/2004 Townsend
6,817,543 B2 11/2004 Clark
6,820,825 B1 11/2004 Wang
6,827,291 B2 12/2004 Townsend
6,834,816 B2 12/2004 Kah, Jr.
6,840,460 B2 1/2005 Clark
6,848,632 B2 2/2005 Clark
6,854,664 B2 2/2005 Smith
6,869,026 B2 3/2005 McKenzie
6,871,795 B2 3/2005 Anuskiewicz
6,880,768 B2 4/2005 Lau
6,883,727 B2 4/2005 De Los Santos
6,921,030 B2 7/2005 Renquist
6,942,164 B2 9/2005 Walker
6,945,471 B2 9/2005 McKenzie
6,957,782 B2 10/2005 Clark
6,997,393 B1 2/2006 Angold
7,017,831 B2 3/2006 Santiago
7,017,837 B2 3/2006 Taketomi
7,028,920 B2 4/2006 Hekman
7,028,927 B2 4/2006 Mermet
7,032,836 B2 4/2006 Sesser et al.
7,032,844 B2 4/2006 Cordua
7,040,553 B2 5/2006 Clark
7,044,403 B2 5/2006 Kah
7,070,122 B2 7/2006 Burcham
7,090,146 B1 8/2006 Ericksen
7,100,842 B2 9/2006 Meyer
7,104,472 B2 9/2006 Renquist
7,111,795 B2 9/2006 Thong
7,143,957 B2 12/2006 Nelson
7,143,962 B2 12/2006 Kah
7,152,814 B1 12/2006 Schapper et al.
7,156,322 B1 1/2007 Heitzman
7,159,795 B2 1/2007 Sesser et al.
7,168,634 B2 1/2007 Onofrio
7,232,081 B2 6/2007 Kah, Jr. et al.
7,234,651 B2 * 6/2007 Mousavi et al. ..... 239/201
7,240,860 B2 7/2007 Vander Griend
7,287,711 B2 10/2007 Crooks
7,293,721 B2 11/2007 Roberts
7,303,147 B1 12/2007 Danner
7,303,153 B2 12/2007 Han
7,322,533 B2 1/2008 Grizzle
7,337,988 B2 3/2008 McCormick
RE40,440 E 7/2008 Sesser
7,392,956 B2 7/2008 McKenzie
7,429,005 B2 9/2008 Schapper
7,478,526 B2 1/2009 McAfee
7,533,833 B2 5/2009 Wang
7,581,687 B2 9/2009 Feith
7,584,906 B2 9/2009 Lev
7,597,273 B2 10/2009 McAfee
7,607,588 B2 10/2009 Nobili
7,611,077 B2 11/2009 Sesser
7,621,467 B1 11/2009 Garcia
7,654,474 B2 2/2010 Cordua
7,686,235 B2 3/2010 Roberts
7,686,236 B2 3/2010 Alexander
7,703,706 B2 4/2010 Walker
D615,152 S 5/2010 Kah
7,766,259 B2 8/2010 Feith
D628,272 S 11/2010 Kah
7,828,229 B2 11/2010 Kah
7,850,094 B2 12/2010 Richmond
7,861,948 B1 1/2011 Crooks
D636,459 S 4/2011 Kah
7,926,746 B2 4/2011 Melton
7,971,804 B2 7/2011 Roberts
RE42,596 E 8/2011 Sesser
8,006,919 B2 8/2011 Renquist
8,047,456 B2 11/2011 Kah
8,056,829 B2 11/2011 Gregory
8,074,897 B2 12/2011 Hunnicutt
8,205,811 B2 6/2012 Cordua
8,272,583 B2 9/2012 Hunnicutt
2001/0023901 A1 9/2001 Haverstraw
2002/0070289 A1 6/2002 Hsu
2002/0130202 A1 9/2002 Kah, Jr. et al.
2002/0153434 A1 10/2002 Cordua
2003/0006304 A1 1/2003 Cool
2003/0015606 A1 1/2003 Cordua
2003/0042327 A1 3/2003 Beutler
2003/0071140 A1 4/2003 Roman
2003/0075620 A1 4/2003 Kah
2004/0108391 A1 6/2004 Onofrio
2005/0006501 A1 1/2005 Englefield
2005/0161534 A1 7/2005 Kah, Jr. et al.
2005/0194464 A1 9/2005 Bruninga
2005/0194479 A1 9/2005 Curtis
2006/0038046 A1 2/2006 Curtis
2006/0086832 A1 4/2006 Roberts
2006/0086833 A1 4/2006 Roberts
2006/0108445 A1 5/2006 Pinch
2006/0144968 A1 7/2006 Lev
2006/0237198 A1 10/2006 Crampton
2006/0273202 A1 12/2006 Su
2006/0281375 A1 12/2006 Jordan
2007/0012800 A1 1/2007 McAfee
2007/0034711 A1 2/2007 Kah
2007/0034712 A1 2/2007 Kah
2007/0181711 A1 8/2007 Sesser

(56) References Cited

U.S. PATENT DOCUMENTS

| | | | |
|---|---|---|---|
| 2007/0235565 | A1 | 10/2007 | Kah, Jr. et al. |
| 2007/0246567 | A1 | 10/2007 | Roberts |
| 2008/0169363 | A1 | 7/2008 | Walker |
| 2008/0217427 | A1 | 9/2008 | Wang |
| 2008/0257982 | A1 | 10/2008 | Kah |
| 2008/0276391 | A1 | 11/2008 | Jung |
| 2008/0277499 | A1 | 11/2008 | McAfee |
| 2009/0008484 | A1 | 1/2009 | Feith |
| 2009/0014559 | A1 | 1/2009 | Marino |
| 2009/0072048 | A1 | 3/2009 | Renquist |
| 2009/0078788 | A1 | 3/2009 | Holmes |
| 2009/0108099 | A1 | 4/2009 | Porter |
| 2009/0140076 | A1 | 6/2009 | Cordua |
| 2009/0173803 | A1 | 7/2009 | Kah |
| 2009/0173904 | A1 | 7/2009 | Roberts |
| 2009/0188988 | A1 | 7/2009 | Walker |
| 2010/0090024 | A1 | 4/2010 | Hunnicutt |
| 2010/0108787 | A1 | 5/2010 | Walker |
| 2010/0176217 | A1 | 7/2010 | Richmond |
| 2010/0257670 | A1 | 10/2010 | Hodel |
| 2010/0276512 | A1 | 11/2010 | Nies |
| 2010/0301135 | A1 | 12/2010 | Hunnicutt |
| 2010/0301142 | A1 | 12/2010 | Hunnicutt |
| 2011/0024522 | A1 | 2/2011 | Anuskiewicz |
| 2011/0024526 | A1 | 2/2011 | Feith |
| 2011/0089250 | A1 | 4/2011 | Zhao |
| 2011/0121097 | A1 | 5/2011 | Walker |
| 2011/0248093 | A1 | 10/2011 | Kim |
| 2011/0248094 | A1 | 10/2011 | Robertson |
| 2011/0248097 | A1 | 10/2011 | Kim |
| 2011/0309161 | A1 | 12/2011 | Renquist |
| 2012/0012670 | A1 | 1/2012 | Kah |
| 2012/0061489 | A1 | 3/2012 | Hunnlcutt |
| 2012/0153051 | A1 | 6/2012 | Kah |
| 2012/0292403 | A1 | 11/2012 | Hunnicutt |

FOREIGN PATENT DOCUMENTS

| | | | |
|---|---|---|---|
| CN | 2794646 | | 7/2006 |
| CN | 2805823 | | 8/2006 |
| DE | 1283591 | B | 11/1968 |
| DE | 3335805 | A1 | 2/1985 |
| EP | 463742 | | 1/1992 |
| EP | 489679 | | 6/1992 |
| EP | 518579 | | 12/1992 |
| EP | 572747 | | 12/1993 |
| EP | 646417 | | 4/1995 |
| EP | 0724913 | A2 | 7/1996 |
| EP | 0761312 | A1 | 12/1997 |
| EP | 1016463 | | 7/2000 |
| EP | 1043077 | | 10/2000 |
| EP | 1043075 | A1 | 11/2000 |
| EP | 1173286 | | 1/2002 |
| EP | 1250958 | | 10/2002 |
| EP | 1270082 | | 1/2003 |
| EP | 1289673 | | 3/2003 |
| EP | 1426112 | | 6/2004 |
| EP | 1440735 | | 7/2004 |
| EP | 1452234 | | 9/2004 |
| EP | 1502660 | | 2/2005 |
| EP | 1508378 | | 2/2005 |
| EP | 1818104 | | 8/2007 |
| EP | 1944090 | | 7/2008 |
| EP | 2251090 | A2 | 11/2010 |
| EP | 2255884 | A1 | 12/2010 |
| GB | 1234723 | | 6/1971 |
| GB | 2330783 | | 5/1999 |
| WO | 9520988 | | 8/1995 |
| WO | 9727951 | | 8/1997 |
| WO | WO9735668 | | 10/1997 |
| WO | 0007428 | | 12/2000 |
| WO | 0131996 | | 5/2001 |
| WO | 0162395 | | 8/2001 |
| WO | 02078857 | | 10/2002 |
| WO | 02098570 | | 12/2002 |
| WO | 03086643 | | 10/2003 |
| WO | 2004052721 | | 6/2004 |
| WO | WO2005099905 | | 10/2005 |
| WO | 2005115554 | | 12/2005 |
| WO | 2005123263 | | 12/2005 |
| WO | 2006108298 | | 10/2006 |
| WO | 2007131270 | | 11/2007 |
| WO | 2008130393 | | 10/2008 |
| WO | 2009036382 | | 3/2009 |
| WO | 2010036241 | | 4/2010 |
| WO | 2010126769 | | 11/2010 |

OTHER PUBLICATIONS

U.S. Appl. No. 12/686,895, filed Jan. 13, 2010.
U.S. Appl. No. 61/681,798, filed Aug. 10, 2012.
U.S. Appl. No. 61/681,802, filed Aug. 10, 2012.
U.S. Appl. No. 13/828,582, filed Mar. 14, 2013.
United States Patent and Trademark Office, Dec. 4, 2012 Office Action in U.S. Appl. No. 12/686,895.
U.S. Appl. No. 12/248,644, filed Oct. 9, 2008.
U.S. Appl. No. 13/300,946, filed Nov. 21, 2011.
U.S. Appl. No. 12/475,242, filed May 29, 2009.
U.S. Appl. No. 12/720,261, filed Mar. 9, 2010.
U.S. Appl. No. 12/952,369, filed Nov. 23, 2010.
U.S. Appl. No. 13/495,402, filed Jun. 13, 2012.
U.S. Appl. No. 13/560,423, filed Jul. 27, 2012.
Office Action for U.S. Appl. No. 13/300,946, mailed on Oct. 12, 2012.
Office Action for U.S. Appl. No. 13/300,946, mailed on Jun. 7, 2012.
United States Patent and Trademark Office, Apr. 10, 2013 Office Action in U.S. Appl. No. 13/562,825.
U.S. Appl. No. 13/562,825, filed Jul. 31, 2012.
Office Action for U.S. Appl. No. 13/562,825, mailed on Oct. 15, 2012.
Jun. 25, 2012 Response to Office Action, U.S. Appl. No. 13/300,946.
Office Action mailed Apr. 5, 2011 in U.S. Appl. No. 11/947,571.
Response to Office Action filed Nov. 24, 2010 in U.S. Appl. No. 11/947,571.
Office Action mailed Aug. 24, 2010 in U.S. Appl. No. 11/947,571.
Response to Office Action filed Jul. 5, 2011 in U.S. Appl. No. 11/947,571.
Advisory Action mailed Jul. 14, 2011 in U.S. Appl. No. 11/947,571.
Sep. 30, 2010 Office Action, U.S. Appl. No. 12/248,644.
Jan. 5, 2011 Office Action, U.S. Appl. No. 12/248,644.
Aug. 5, 2010 EPO Search Report and Opinion, EPO Application No. 10164085.2.
Mar. 29, 2011 Office Action, U.S. Appl. No. 12/475,242.
Interview Summary mailed Sep. 26, 2011 in U.S. Appl. No. 12/475,242.
Office Action mailed Jul. 20, 2011 in U.S. Appl. No. 12/475,242.
Response to Office Action filed Apr. 29, 2011 in U.S. Appl. No. 12/475,242.
Response to Office Action filed Oct. 18, 2011 in U.S. Appl. No. 12/475,242.
USPTO Office Action in U.S. Appl. No. 13/300,946, Mailed Jun. 7, 2012.
USPTO Office Action in U.S. Appl. No. 13/300,946, Mailed Oct. 12, 2012.
USPTO Office Action in U.S. Appl. No. 13/562,825, Mailed Oct. 15, 2012.
U.S. Appl. No. 12/757,912, filed Apr. 19, 2010.
U.S. Appl. No. 12/859,159, filed Aug. 18, 2010.
U.S. Appl. No. 13/069,334, filed Mar. 22, 2011.
U.S. Appl. No. 13/523,846, filed Jun. 14, 2012.

* cited by examiner

VARIABLE ARC NOZZLE

CROSS REFERENCE TO RELATED APPLICATION

This application is a continuation-in-part of U.S. patent application Ser. No. 11/622,772, filed Jan. 12, 2007, which is incorporated herein by reference in its entirety.

FIELD OF THE INVENTION

This invention relates to irrigation sprinklers, and, more particularly, to sprinklers having a variable arc nozzle for adjusting the arcuate span of water distribution.

BACKGROUND OF THE INVENTION

The use of sprinklers is a common method of irrigating areas of grass, trees, flowers, crops, and other types of vegetation. In a typical irrigation system, many different types of sprinklers may be used to distribute water over a desired area. One type of irrigation sprinkler that is commonly used is a spray head sprinkler having a nozzle that produces a fan-shaped spray projected outwardly in an arcuate pattern about the sprinkler. Typically, such spray heads are mounted on either stationary risers or on pop-up risers that are movably mounted in a housing buried in the ground. In case of a pop-up riser, the riser is retracted into the housing when the sprinkler is not in operation and extends out of the housing and above the ground when the sprinkler is in operation. There are several concerns, however, that arise when using such variable arc spray nozzles: (1) insufficient adjustability of the arcuate span of the water distribution; (2) insufficient water distribution to terrain relatively close to the sprinkler; (3) lack of a uniform water precipitation rate between arcs of different spans; and (4) lack of uniform water distribution at the edges of the distribution pattern.

First, in many instances, it is desirable to control the arcuate area over which the sprinkler distributes water. In this regard, it is often desirable to use a spray nozzle that distributes water through a variable pattern in virtually infinite arcuate settings between a full circle pattern and a very small arcuate pattern of about 5° or less.

Second, it is desirable to have a portion of the spray distributed close in to the sprinkler to avoid producing a donut-shaped watering pattern about the sprinkler. Many commercially available variable arc spray nozzles tend to distribute water in a donut-shaped pattern with little water being distributed in the region close to the sprinkler. Thus, regions that are further from the sprinkler generally receive more water than regions that are closer to the sprinkler. Accordingly, there is a need for a variable arc nozzle that provides a water distribution pattern that includes appropriate watering near the sprinkler.

Third, variable arc nozzles often generate different precipitation rates, depending on the size of the arcuate span of water distribution selected by the user. Generally, smaller arc settings tend to result in higher precipitation rates because a given amount of water is distributed over a smaller area. For example, when the size of the arc is reduced (such as from full circle to half circle), if the flow rate is not also reduced, the resulting precipitation rate will be relatively high for the reduced area of coverage. In most instances, it is highly desirable that each sprinkler in the system provide a uniform amount of water to the selected watering area so that all vegetation receives the same amount of water over a given time regardless of the arcuate span of the water distribution.

Thus, there is a need for a variable arc nozzle that proportionally adjusts the flow rate through the nozzle as the arcuate span of the water distribution is adjusted by the user.

Typically, the water precipitation rate of conventional spray head sprinklers is generally not homogenous along the radius of distribution. The water precipitation rate depends on the square of the distance from the sprinkler. Accordingly, in many instances, the flow rates of nozzles are specifically set by the manufacturer to different amounts depending on the radius of coverage of the nozzle. The flow rates of nozzles designed for closer ranges of coverage, such as four, six, or eight feet, are therefore less than that for nozzles designed for more distant ranges of coverage, such as ten, twelve, or fifteen feet.

One method of decreasing flow rate is by the use of arcuate water outlet spray slots that are relatively narrow, e.g., on the order of 0.02 inches. The use of these relatively narrow slots is especially common for fan spray nozzles intended to provide a relatively close range of coverage, such as four, six, or eight feet. These narrow slots, however, are easily clogged by dirt or other debris. Thus, there is a need for variable arc nozzles that proportionally adjust the flow rate through the nozzle to avoid using narrow arcuate outlet slots that can become clogged.

Fourth, there is a need to improve the water definition and evenness at the edges of the water distribution arc. There are often irregularities and gaps at the edges of the arc. For example, while water in the central part of an arc distribution pattern is generally thrown a uniform distance from the nozzle, the water at the edges of the arc is not thrown as far. Also, even for terrain along the edges relatively close to the nozzle, there is uneven water distribution. Where multiple sprinklers are used to cover a given terrain, this unevenness at the edges results in gaps of coverage and non-uniform coverage, especially at the transition areas from one sprinkler's coverage to another and at areas close to the individual sprinklers.

The irregularities and gaps at the edges result from components of the variable arc nozzle known as edge "fins," which are used to define the size of the water distribution arc. The gaps and irregularities at the edges of the water distribution arc generally arise from three factors associated with these edge fins. First, the fins generate frictional drag against water distributed at the edges of the pattern that is not present at the center of the pattern where there are no fins. This drag, in turn, reduces the throw distance of water at the edges of the arc distribution pattern. Second, there is a significant tangential component of water flow at the edge fins. Some of the tangential flow results from leakage between mating components of the nozzle, causing deflection of a portion of the outwardly projected flow and resulting in gaps and uneven water distribution. Third, conventional edge fins do not sufficiently channel the outwardly projected flow along the edges of the arc, again resulting in a tangential component of flow and uneven water distribution.

Accordingly, it is desirable to have a variable arc nozzle that: (1) adjusts to about any desired arcuate span of water distribution; (2) provides increased water distribution to terrain near the sprinkler; (3) provides a relatively constant water precipitation rate regardless of the size of the arcuate span of water distribution selected by the user; and (4) provides a water distribution arc with fairly even water distribution at the edges of the arc. Depending on the specific needs of the user, it may be desirable to incorporate one or more of the above features into a given variable arc nozzle. The present invention fulfills these needs and provides further related advantages.

DESCRIPTION OF THE PREFERRED EMBODIMENTS

Figure 1:
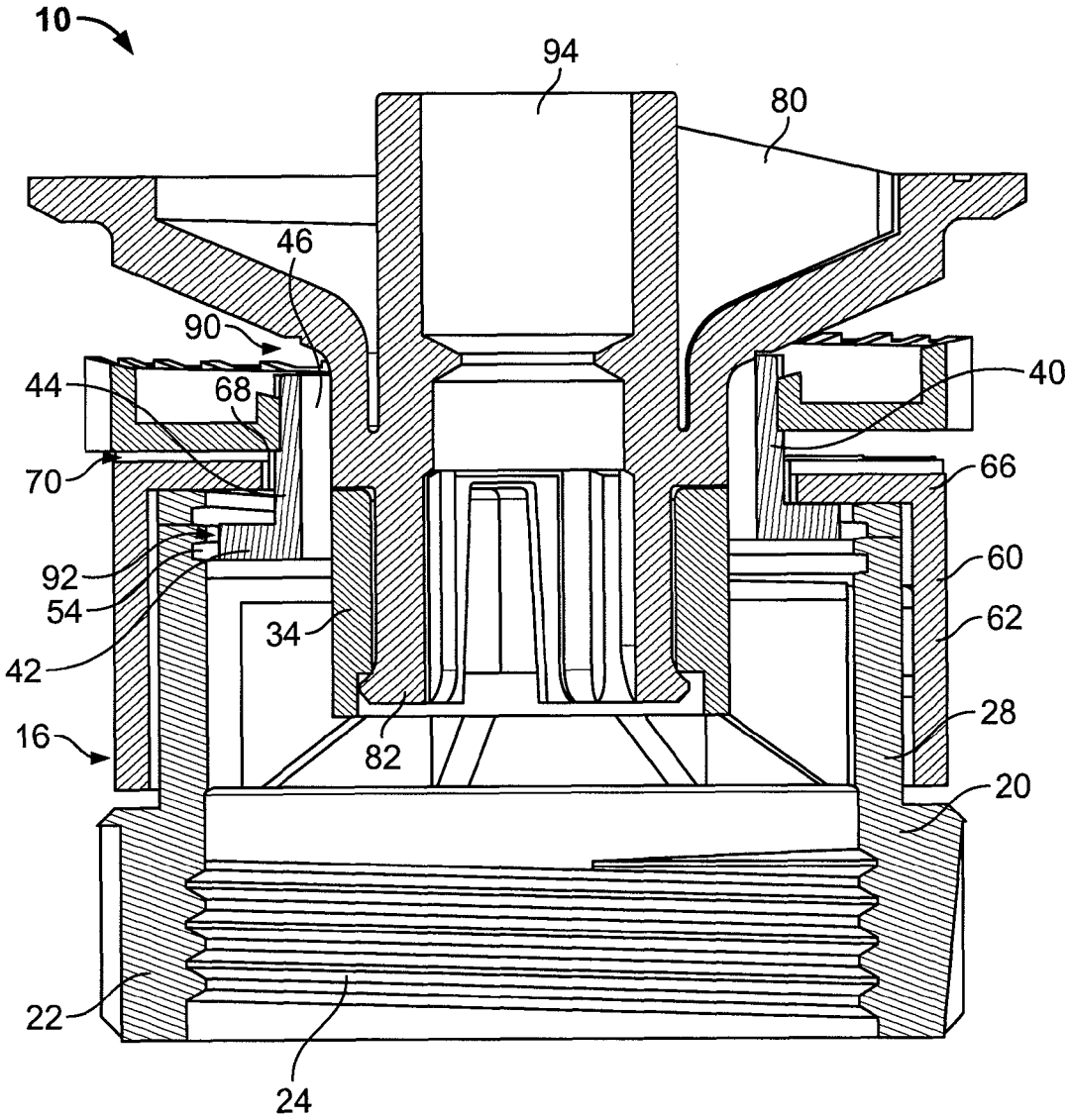
FIG. 1 is a cross-sectional view of a first embodiment of a variable arc nozzle embodying features of the present invention to provide increased water distribution near the nozzle.

FIGS. 1-17 illustrate five preferred embodiments of an improved variable arc nozzle that may be adjusted to virtually any arcuate span of water distribution that may be desired for irrigation. The first and second embodiments also illustrate a nozzle providing improved close-in watering of terrain near the nozzle (FIGS. 1-7). The third and fourth embodiments show a nozzle providing a relatively constant water precipitation rate regardless of the arcuate span of the water distribution (FIGS. 8-12). The fifth embodiment illustrates a nozzle providing improved water distribution at the edges of the water distribution arc (FIGS. 13-17).

With reference to FIGS. 1-5, the first embodiment of a variable arc nozzle 10 generally comprises a spray head nozzle unit or head having a body 16 adapted for convenient thread-on mounting onto the upper end of a stationary or pop-up tubular riser (not shown). The nozzle 10 defines an upper arcuate slot 90 and a lower arcuate slot 92. In operation, water under pressure is delivered through the riser to the nozzle body 16 and discharged from the body through the upper arcuate slot 90 and the lower arcuate slot 92 for irrigation. The arcuate extent of the two arcuate slots 90 and 92 is readily adjustable from anywhere between 0° (off) to 360° (fully open). The lower slot 92 generally provides close in watering near the nozzle 10, and the upper slot 90 provides water for the water pattern beyond the close in area.

More specifically, the variable arc nozzle 10 includes several components with complementary surfaces in the shape of a 360 degree spiral, or helical turn or revolution, with axially offset ends. These complementary surfaces cooperate to form the upper and lower arcuate slots 90 and 92 with the same arcuate span of water distribution and which can be adjusted to virtually any arcuate span desired for irrigation. The upper arcuate slot 90 emits water from a primary outlet for watering a vast majority of the distribution pattern which is beyond that watered by the lower slot 92. The lower arcuate slot 92 emits the water from a secondary outlet for watering an area relatively close to the nozzle 10. The upper and lower arcuate slots 90 and 92 lie in the path of a first and second flow path, respectively.

Figure 2:
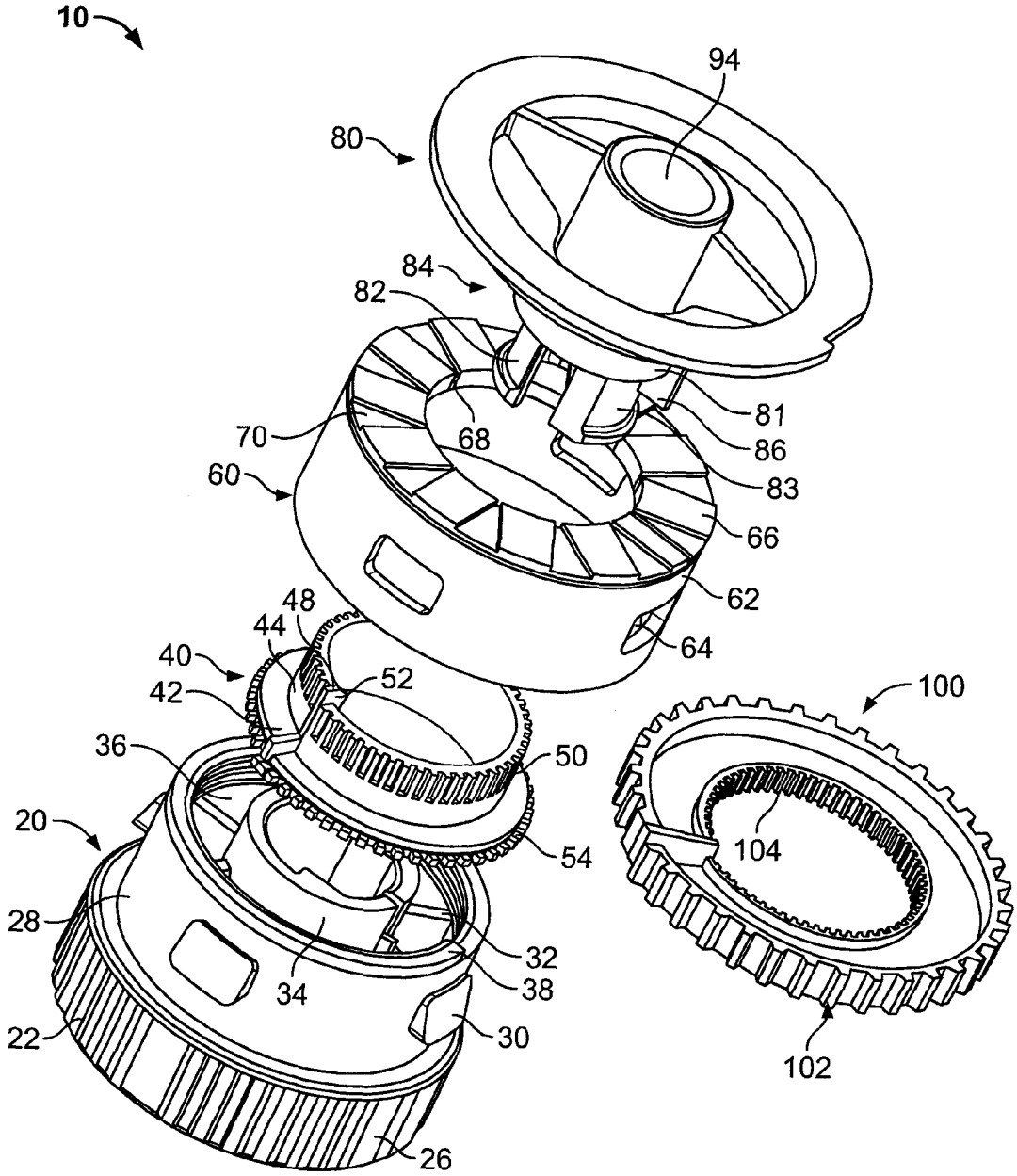
FIG. 2 is an exploded perspective view of the variable arc nozzle of FIG. 1.

As shown in FIG. 2, the components providing the complementary surfaces include a base 20, a collar 40, a cover 60, and a deflector 80. Each of these components preferably have complementary spiral-like surfaces, i.e., surfaces generally in the shape of a single 360 degree helical turn or revolution with axially offset ends, that cooperate with one another to form the upper and lower arcuate slots 90 and 92. The upper arcuate slot 90 is formed by the helical engagement of the collar 40 and the deflector 80 and lies within the first water flow path. The lower arcuate slot 92 is formed by the helical engagement of the collar 40 and the cover 60 and lies within the second water flow path. The nature of the components and the operation of the nozzle 10 are set forth more fully below.

The base 20 has a generally cylindrical shape with a lower end 22 having internal threading 24 for quick and easy thread-on mounting onto an upper end of a riser having complementary exterior threading (not shown). The lower end 22 also has a grippable external surface 26 (such as a series of vertically extending ribs) to assist in holding and turning the base 20 for mounting onto the riser. An outer wall 28 extends upward from the lower end 22 of the base 20. The outer wall 28 has several locking tabs 30, protruding outwardly therefrom. The four tabs 30 are preferably spaced equidistantly about the perimeter of the outer wall 28. The tabs 30 interlockably engage the cover 60 to attach the cover 60 to the base 20.

Figure 3:
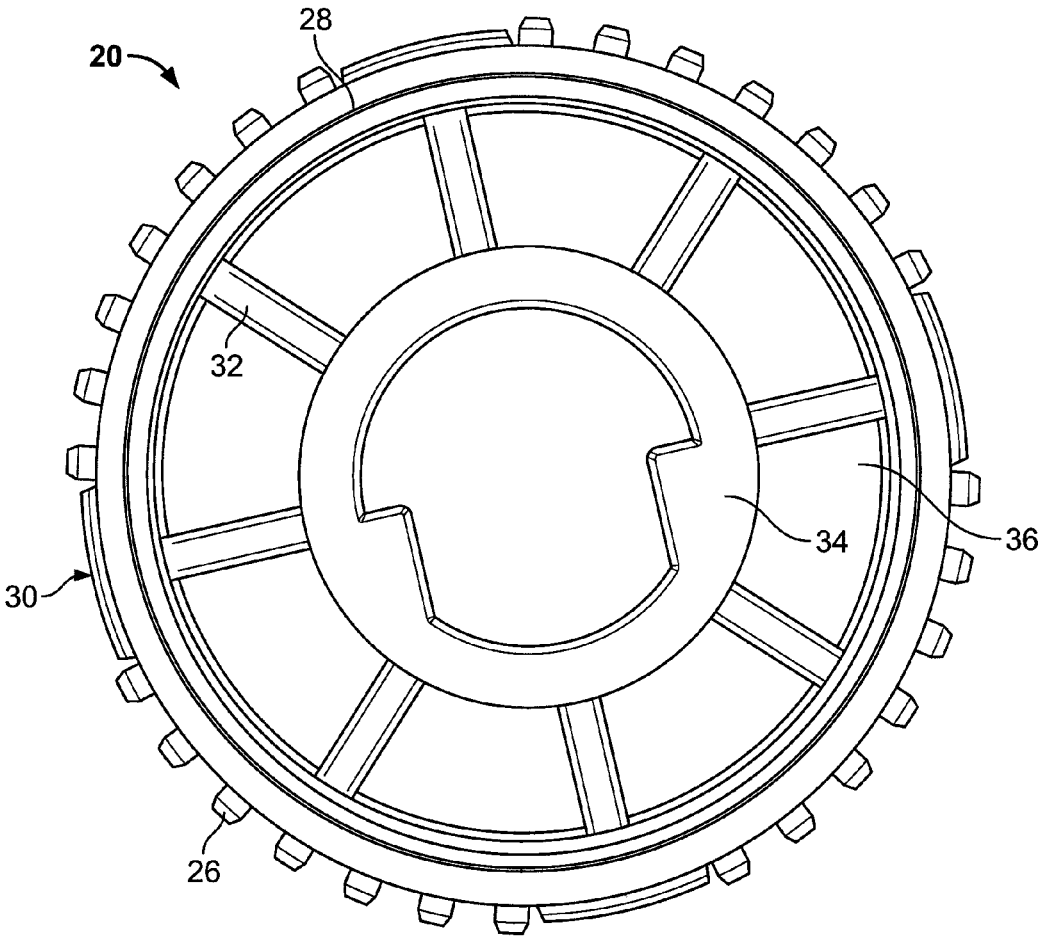
FIG. 3 is a top plan view of the base of the variable arc nozzle of FIG. 1.

As shown in FIGS. 2 and 3, the base 20 includes a set of spoke-like ribs 32 that interconnect the outer wall 28 to a central hub 34. The ribs 32 define flow passages 36 that permit water flow through the base 20 and into the collar 40. The upper edge 38 of the outer wall 28 defines a spiral, or helical turn or revolution, with axially offset ends for engagement with the collar 40.

The collar 40 includes a radially extending, ring-like flange 42 that also has a spiral or helical turn or revolution configuration, with axially offset ends. The flange 42 preferably sits between complementary portions of the base 20 and the cover 60. More specifically, the flange 42 sits atop the edge 38 of the base 20 and underneath a spiral surface of the cover 60, as described below. The collar 40 also includes a central hub 44, which extends upwardly from the inner circular edge of the flange 42. The central hub 44 has an upper edge 48 in the shape of a spiral, or helical turn or revolution, that engages a complementary spiral surface on the underside of the deflector 80, as described below.

Figure 4:
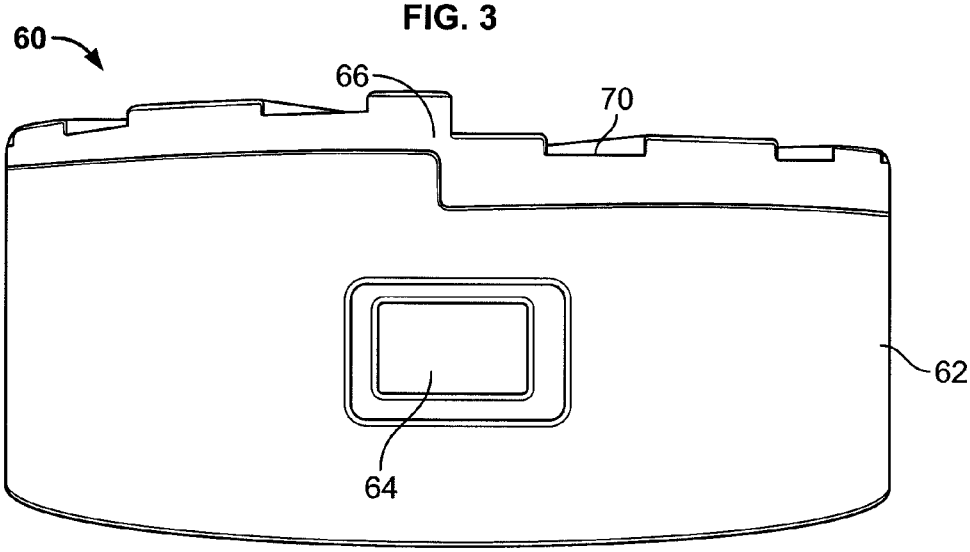
FIG. 4 is a front elevational view of the cover of the variable arc nozzle of FIG. 1.

With reference to FIGS. 2 and 4, the cover 60 has an outer wall 62 defining a number of apertures 64. There are preferably four apertures 64 to each receive one of the tabs 30 to interlock the cover 60 with the base 20. As should be evident, other ways may be used to fasten the cover 60 to the base 20, such as a threaded engagement or by sonic welding.

The cover 60 also preferably includes a ring-like central hub 66 that defines a spiral, or a helical turn or revolution. When the base 20 and cover 60 are interlockably engaged, the complementary spiral edge 38 surfaces of the base 20, the flange 42 of the collar 40, and underside surface of the cover 60 are stacked vertically one atop another (FIG. 1). More specifically, the underside of the ring-like central hub 66 of the cover 60 preferably sits vertically atop the ring-like flange 42 of the collar 40, which, in turn, sits vertically atop the spiral upper edge 38 of the base 20.

Figure 5:
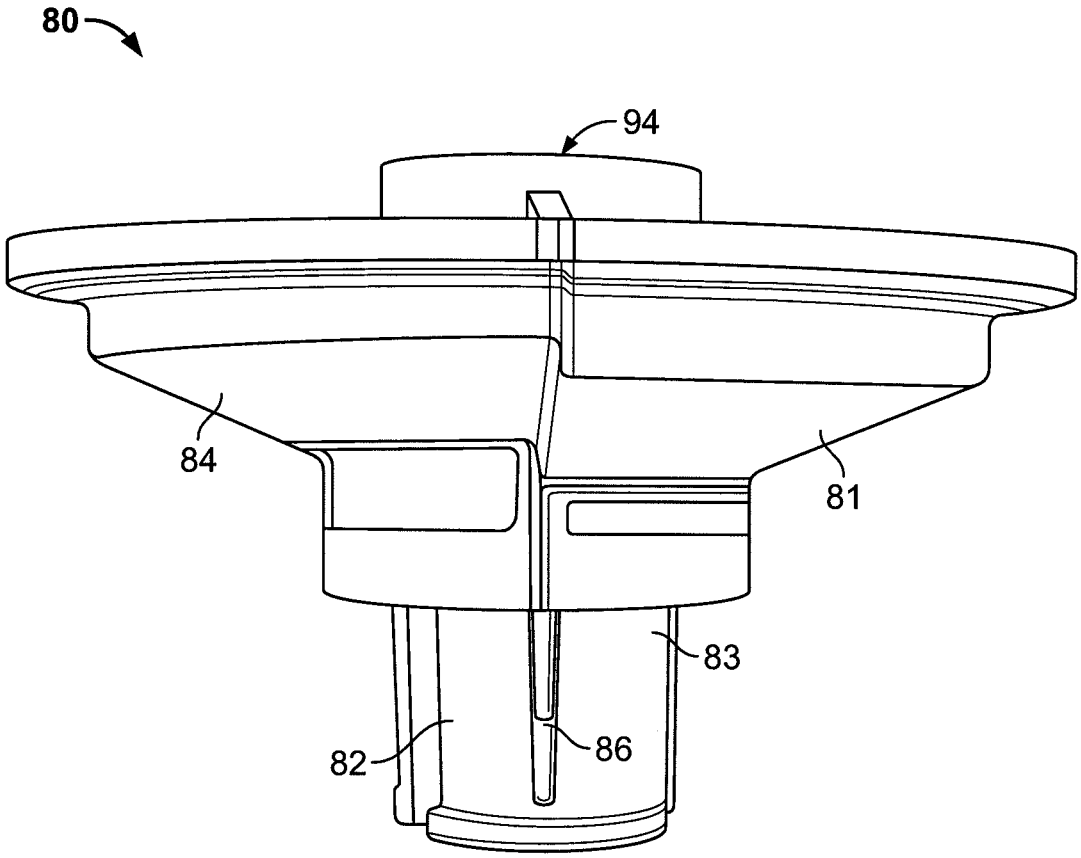
FIG. 5 is a front elevational view of the deflector of the variable arc nozzle of FIG. 1.

With reference to FIGS. 2 and 5, the deflector 80 has a generally frusto-conical shape with an enlarged head portion 81 for deflecting and redirecting water and a lower stem portion 83 divided into two-prongs 82. The underside 84 of the head portion 81 of the deflector 80 defines a spiral, or helical turn or revolution. During assembly, the lower end of the stem portion 83 is inserted through the central hubs 34, 44, and 66 of the base 20, collar 40, and cover 60, respectively. The prongs 82 of the lower end of the stem portion 83 lock with the central hub 34 of the base 20 (FIG. 1). The cover 60 also is fixed with respect to the base 20 and the deflector 80 through the tabs 30 and apertures 64, as described above. The collar 40, however, is rotatable with respect to the base 20, the cover 60, and the deflector 80. Rotation of the collar 40 allows the arcuate extent of the slots 90 and 92 to be either increased or decreased to thereby control the desired arcuate span of water distribution.

Rotation of the collar 40 is preferably controlled through the use of an adjustment ring 100. The adjustment ring 100 has a knurled external surface 102 for gripping and a splined internal surface 104 for operatively engaging the collar 40. More specifically, the splined internal surface 104 interlockably engages a corresponding splined surface 50 on the central hub 44 of the collar 40. Rotation of the adjustment ring 100 therefore causes corresponding rotation of the collar 40. The adjustment ring 100 is rotatable through approximately one revolution and controls the arcuate extent of the upper and lower slots 90 and 92, which extent is preferably the same for both distant watering and close in watering.

In operation, water entering the nozzle 10 flows along a first flow path and a second flow path. The first flow path supplies water to the upper arcuate slot 90 for the distribution of water to terrain relatively distant from the nozzle 10, while the second flow path supplies water to the lower arcuate slot 92 for the distribution of water to terrain relatively close to the nozzle 10.

In the first flow path, pressurized supply water travels through the flow passages 36 of the base 20 and then flows through a flow conduit externally bounded by the central hub 44 of the collar 40 and internally bounded by the lower stem portion 83 of the deflector 80, as shown in FIG. 1. After traveling through this flow conduit, the water flows through the upper arcuate slot 90 and impacts the underside 84 of the deflector 80. The deflector 80 redirects the water upwardly and outwardly to the desired terrain at a predetermined distance about the nozzle 10.

The spiral upper edge 48 of the collar 40 and the spiral underside surface 84 of the deflector 80 engage one another to define the arcuate extent of the upper slot 90, which determines the arcuate span of the water distribution. More specifically, the arcuate span of water distribution is determined by the position of the upper helical edge 48 of the collar 40 relative to the complementary helical underside surface 84 of the deflector 80. For example, as shown in FIG. 1, the upper slot 90 is open on the left and closed on the right. The collar 40 may be rotated relative to the deflector 80 any arbitrary amount to expand or decrease the size of the arcuate slot 90. Thus, the size of the slot 90 is not limited to discrete arcs, such as a quarter-circle and a half-circle.

When the nozzle 10 is set to be totally shut off, the spiral edge 48 of the collar 40 and the complementary spiral underside surface 84 of the deflector 80 engage one another all the way around so that there is no arcuate slot 90 and the first flow path is therefore obstructed. As the collar 40 is then rotated in the clockwise direction through use of the adjustment ring 100, the upper spiral edge 48 of the collar 40 begins to traverse the helical underside surface 84 of the deflector 80. As it begins to traverse the helical turn, the collar 40 becomes spaced from the deflector 80 and the upper arcuate slot 90 begins to form between the collar 40 and the deflector 80. The arcuate extent of the upper slot 90 increases as the adjustment ring 100 is further rotated clockwise to cause the collar 40 to continue to traverse the helical turn. The adjustment ring 100 may be rotated clockwise until a stop 52 on the collar 40 engages a stop 86 on the deflector 80, preventing further rotation. At this point, the collar 40 has traversed the entire helical turn and the arcuate extent of the upper slot 90 is nearly 360 degrees. In this fully open position, water is distributed in essentially a full circle about the nozzle 10.

When the collar 40 is rotated counterclockwise through use of the adjustment ring 100, the arcuate extent of the upper slot 90 is decreased. The upper spiral edge 48 of the collar 40 traverses the helical turn in the opposition direction, progressively reducing the size of the upper slot 90. When the upper spiral edge 48 has traversed the helical turn completely, the stop 52 of the collar 40 engages the stop 86 of the deflector 80 and prevents further rotation. At this point, the upper slot 90 is closed and the first flow path through the collar 40 is again obstructed against further flow.

In the second flow path, pressurized supply water travels through the flow passages 36 of the base 20 and then flows through the lower arcuate slot 92, which is formed by the engagement of the collar 40 with the cover 60, as described more fully below. Prior to flowing through the lower arcuate slot 92, water is preferably filtered by radially extending teeth 54, preferably about 0.01 inches in length, spaced circumferentially along the outer perimeter of the ring-like flange 42 of the collar 40, as shown in FIG. 2.

The spiral flange 42 of the collar 40 and the spiral underside surface of the cover 60 engage one another to form the lower arcuate slot 92. More specifically, the spiral ring-like flange 42 of the collar 40 engages the underside of the spiral central hub 66 of the cover 60. The interaction between these two opens and closes the lower arcuate slot 92. For example, as shown in FIG. 1, the lower slot 92 is open on the left and closed on the right. The arcuate extent of the lower slot 92 adjusts with the arcuate extent adjustment of the upper arcuate slot 90 by rotation of the collar 40 through the adjustment ring 100.

The spiral surfaces of the collar 40, cover 60, and deflector 80 are preferably aligned so that the angle of the lower arcuate slot 92 is the same as the angle of the upper arcuate slot 90. Thus, rotation of the collar 40 through use of the adjustment ring 100 will preferably result in the same arcuate span of water distribution for both distant and close in watering.

The closing and opening of the lower arcuate slot 92 is similar in operation to that of the upper arcuate slot 90. When in the closed position, the complementary spiral surfaces of the collar 40 and the cover 60 engage one another to obstruct the second flow path. As the collar 40 is rotated in the clockwise direction through use of adjustment ring 100, the ring-like flange 42 of the collar 40 traverses the underside of central hub 66 of the cover 60. As it begins to traverse the helical turn, the collar 40 becomes spaced from the cover 60 and the lower arcuate slot 92 begins to form between the collar 40 and the deflector 80. The adjustment ring 100 may be rotated until stop 52 on the collar 40 engages stop 86 on the deflector 80, preventing further rotation with respect to both the upper and lower arcuate slots 90 and 92. In this position, both the upper and lower arcuate slots 90 and 92 are fully open and distribute water in a full circle to terrain distant from and close to the nozzle 10, respectively. Rotation of the adjustment ring 100 in the counterclockwise direction results in the closing of the lower arcuate slot 92.

After the water flows through the lower arcuate slot 92, it is redirected generally vertically through one or more grooves 68 spaced along the inside circumference of the cover 60. The cover 60, shown in FIGS. 2 and 4, preferably contains twelve such grooves 68 spaced every 30 degrees. Thus, if the lower arcuate slot 92 is open about 90 degrees, water flowing through the lower arcuate slot 92 will be redirected through three grooves 68.

Water flowing through the grooves 68 impacts and is redirected by the underside surface of the adjustment ring 100. The adjustment ring 100 redirects the water radially outward through the triangular flow passages 70 spaced circumferentially about the central hub 66 of the cover 60. The cover 60 preferably contains twelve such triangular flow passages 70 spaced every 30 degrees about the central hub 66, so if the lower arcuate slot 92 is open about 90 degrees, water flowing through the slot 92 will be redirected through three flow passages 70. Given the angle of impact with the cover 60 and adjustment ring 100, the redirection of water flow, and the widening of the triangular flow passages 70, a portion of the water velocity and energy in the second flow path will be dissipated, and the water exiting the triangular flow passages 70 will be distributed to terrain relatively close to the nozzle 10.

The nozzle 10 also preferably includes a bore 94, which accommodates an adjustment screw 196 (shown in FIG. 6 for the second embodiment), or comparable adjustment member. The bore 94 extends through the deflector 80 to a flow adjustment collar, or similar flow rate adjustment device, located below the base 20. One such flow adjustment collar is shown in U.S. Pat. No. 6,814,304, assigned to the assignee of the present invention, which disclosure is incorporated herein by reference. The adjustment screw 196 can be used to selectively set the throw radius of the nozzle 10. Adjustment of the throw radius through use of an adjustment member is independent of adjustment of the arcuate slots 90 and 92, which determines the arcuate span of water distribution.

Figure 6:
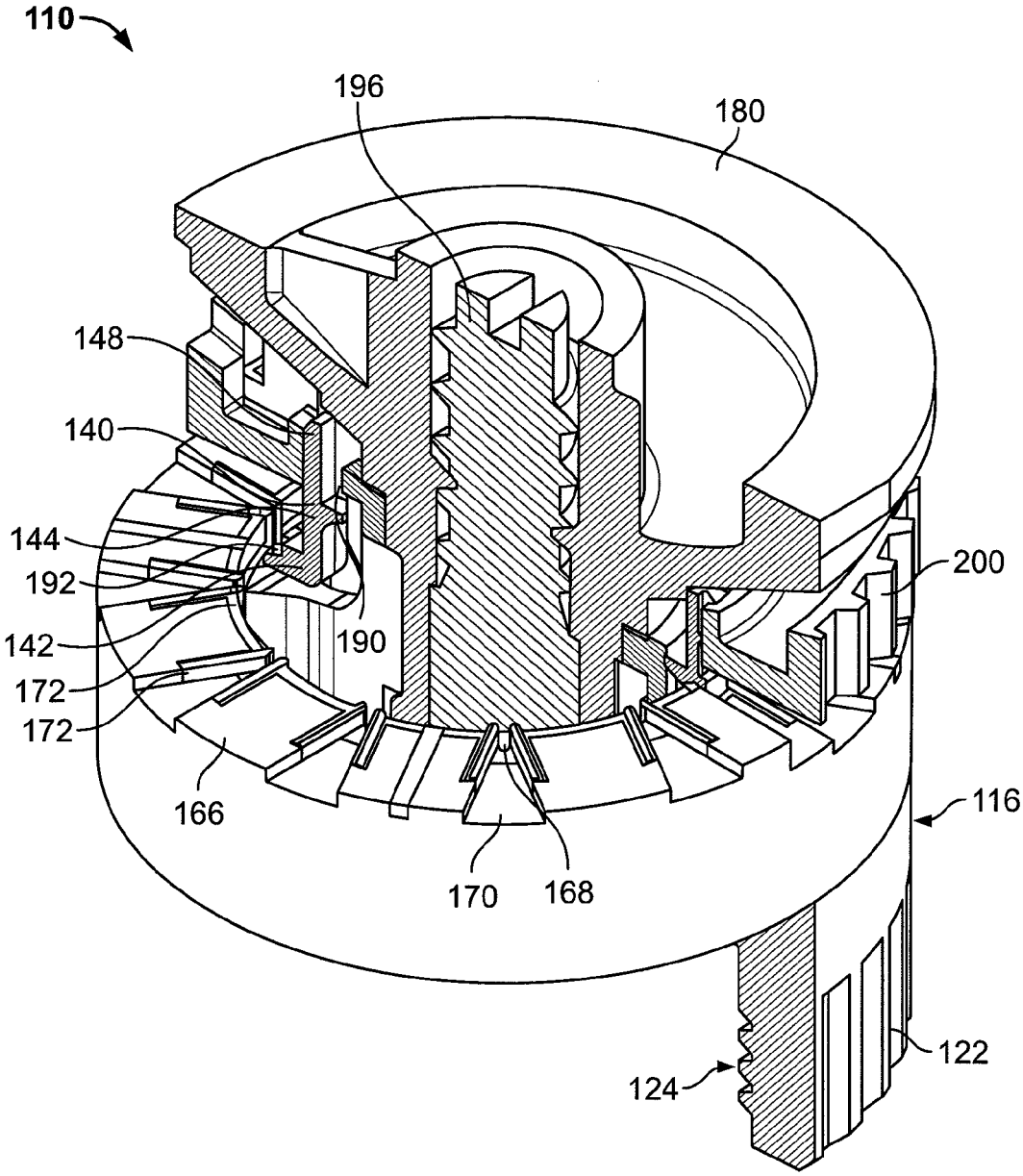
FIG. 6 is a partially cut away perspective view of a second embodiment of a variable arc nozzle embodying features of the present invention to provide increased water distribution near the nozzle.

A second embodiment of the nozzle 110 is shown in FIG. 6. The second embodiment functions essentially in the same manner as described above for the first embodiment. The second embodiment includes generally a nozzle body 116 (which includes a collar 140), a deflector 180, and an adjustment ring 200. In the second embodiment, the nozzle body 116 includes two sonically welded pieces, rather than the base 20 and cover 60 of the first embodiment. This second embodiment saves on tooling and assembly costs.

As shown in FIG. 6, the nozzle body 116 has a lower end 122 with internal threading 124 for mounting onto a riser. The nozzle body 116 also has a ring-like central hub 166 that includes grooves 168 spaced along the inside circumference of the central hub 166 and extending generally vertically to triangular flow passages 170 spaced circumferentially about the central hub 166. The triangular flow passages 170 are preferably reinforced with elastomer seal portions 172 between and along the flow passages 170 to prevent leakage.

Figure 7:
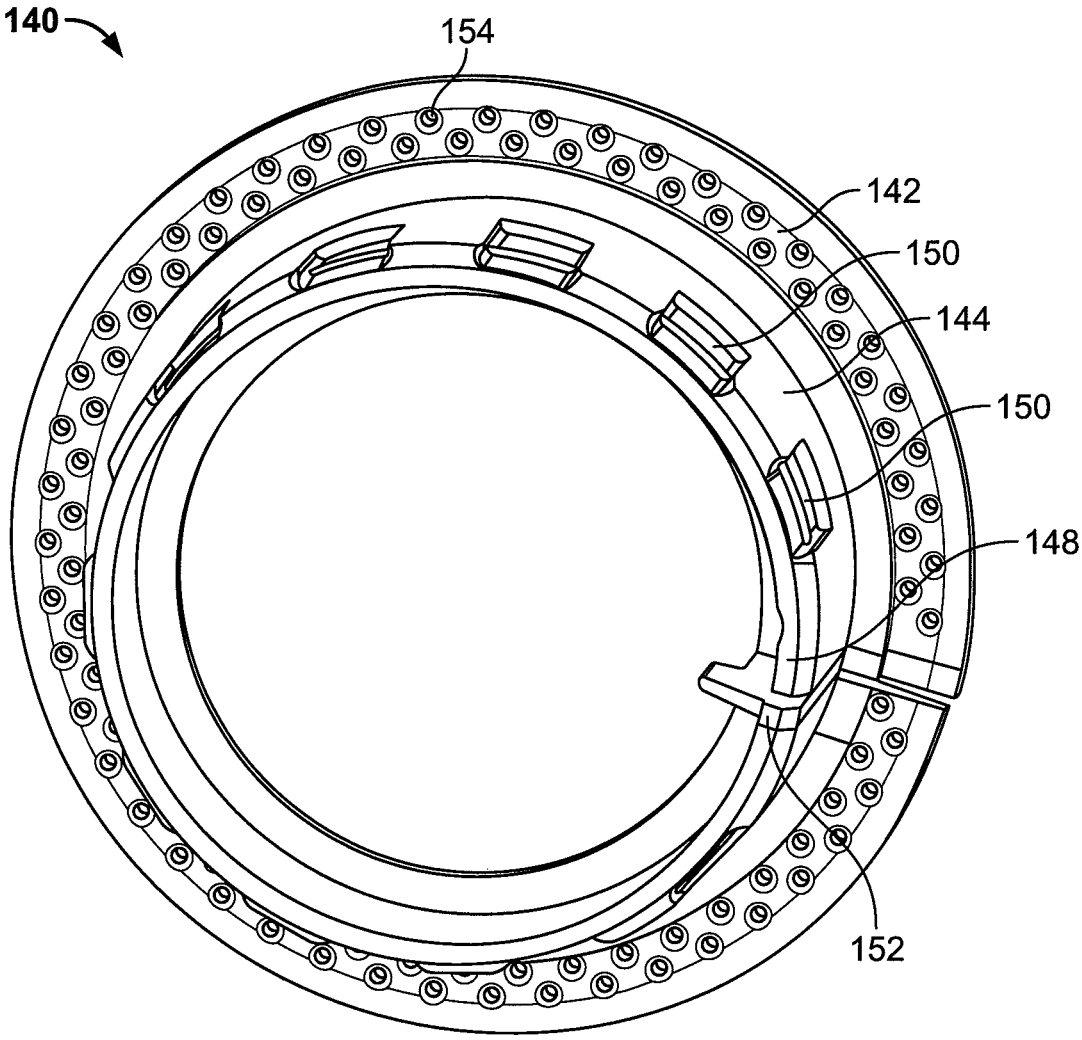
FIG. 7 is a perspective view of the collar of the variable arc nozzle of FIG. 6.

The collar 140 of the second embodiment is shown in FIG. 7. The collar 140 includes a central hub 144 having an upper edge 148 that defines a spiral with axially offset ends and includes a ring-like flange 142 that defines a spiral with axially offset ends. The upper edge 148 helically engages the underside of a deflector 180 to form an upper arcuate slot 190, and the ring-like flange 142 helically engages the nozzle body 116 to form a lower arcuate slot 192. The collar 140 also includes a stop 152 to prevent over-rotation of the collar 140 and a splined surface 150 to interlockably engage adjustment ring 200.

As shown in FIG. 7, the collar 140 is perforated with small holes 154, preferably about 0.01 inches in diameter, to filter water flowing in the second flow path through the lower arcuate slot 192. This filtering mechanism is an alternative to the teeth 54 used in the first embodiment, as shown in FIG. 2, and may also be used with other embodiments.

The spiral surfaces of the second embodiment provide two flow paths through the upper and lower arcuate slots 190 and 192 to distribute water relatively distant from and relatively close to the nozzle 110. For instance, in FIG. 6, the upper and lower arcuate slots 190 and 192 are shown open on the left side of the figure and closed on the right side. The second embodiment also preferably includes an adjustment ring 200 for rotating the collar 140 and an adjustment screw 196 for adjusting the throw radius of the nozzle 110.

Figure 8:
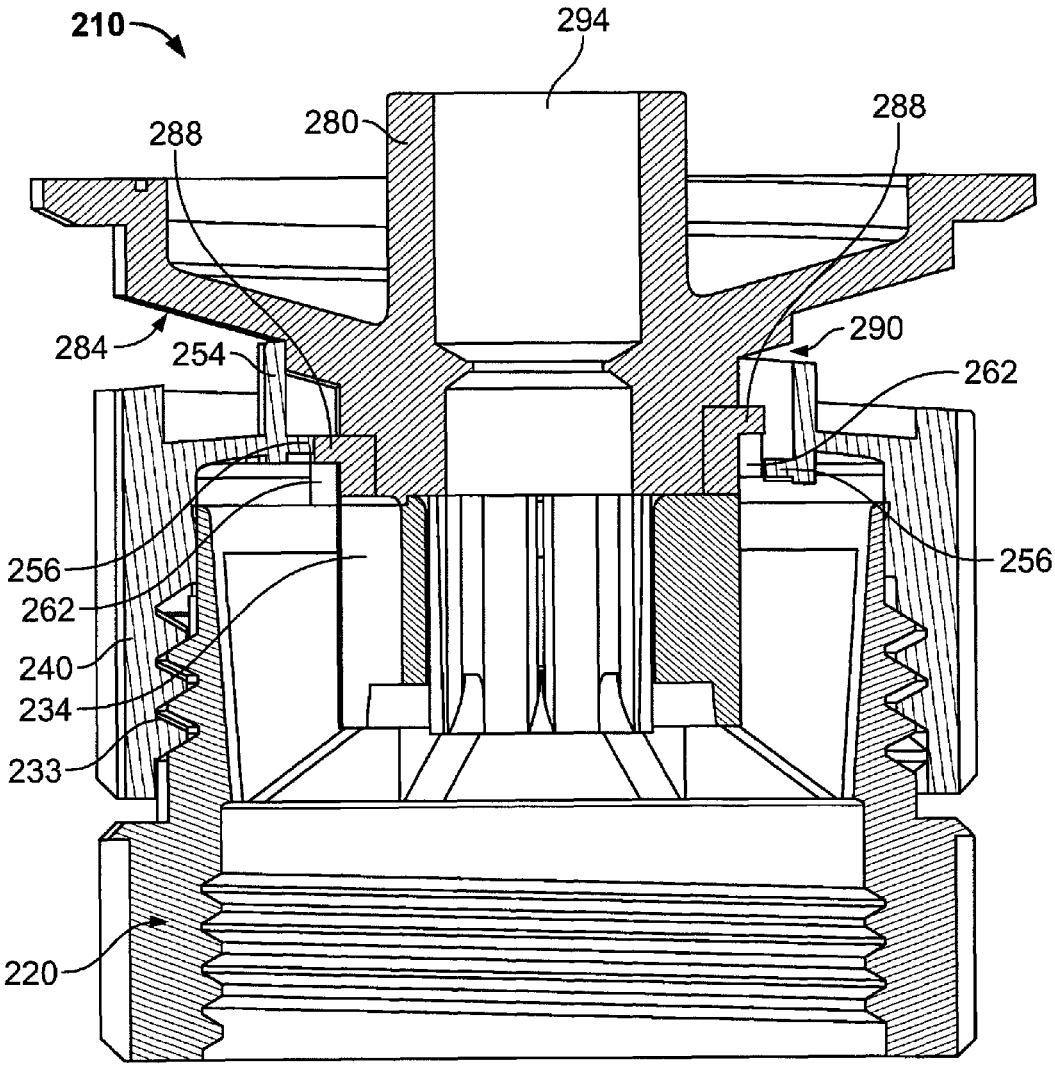
FIG. 8 is a cross-sectional view of a third embodiment of a variable arc nozzle embodying features of the present invention to provide an improved uniform precipitation rate.
Figure 9:
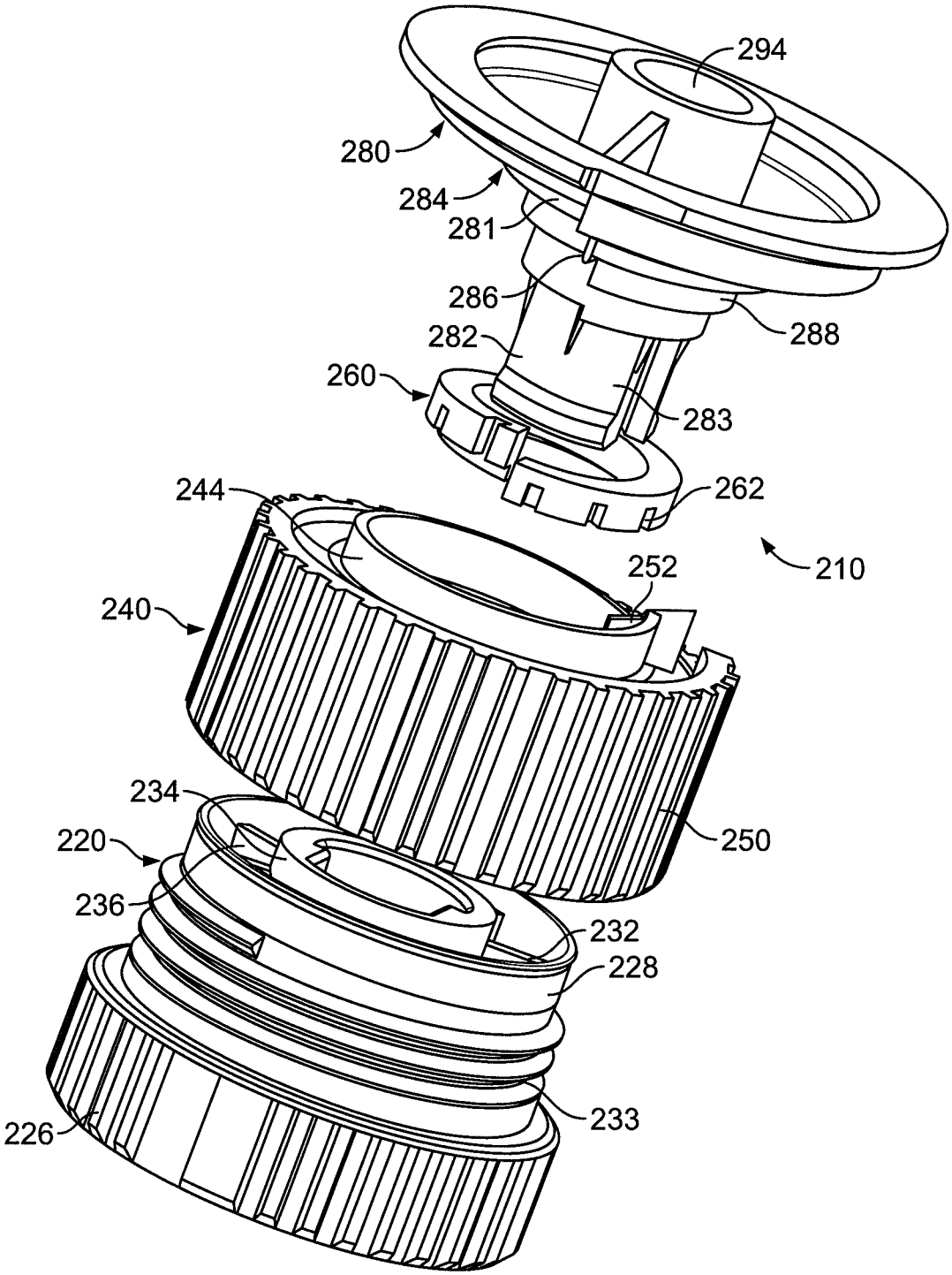
FIG. 9 is an exploded perspective view of the variable arc nozzle of FIG. 8.

A third embodiment of the nozzle 210 is shown in FIGS. 8 and 9. This nozzle 210 preferably maintains a relatively constant water precipitation regardless of the extent of the arcuate span. More specifically, for a given nozzle design and intended radius of coverage, the nozzle 210 maintains a fairly even precipitation rate, i.e., water per area, regardless of the arcuate span of water distribution. Thus, when the arcuate span is large, the flow rate is relatively high, and when the arcuate span is decreased, the flow rate is decreased. This "matched precipitation rate" feature allows for the maintaining of a fairly constant precipitation rate, regardless of the arcuate span selected by the user.

The nozzle 210 preferably includes a base 220, a collar 240, a split ring 260, and a deflector 280. Each of the components preferably includes spiral surfaces for engaging one or more other components to allow adjustability of the arcuate span. The matched precipitation rate is provided by the introduction of one or more notches 262 on the split ring 260 into the flow path of water exiting the nozzle 210. Each notch 262 opens downward and radially outward.

As shown in FIG. 9, the base 220 is generally cylindrical in shape with internal threading for mounting onto a riser. The base 220 includes a grippable external surface 226 to assist in mounting. The base 220 also includes external threading 233 for threading engagement with the collar 240. As shown in FIG. 9, the base 220 includes a set of spoke-like ribs 232 that interconnect the outer wall 228 of the base 220 to the central hub 234. These spoke-like ribs 232 define flow passages 236 that permit water flow through the base 220.

Figure 10:
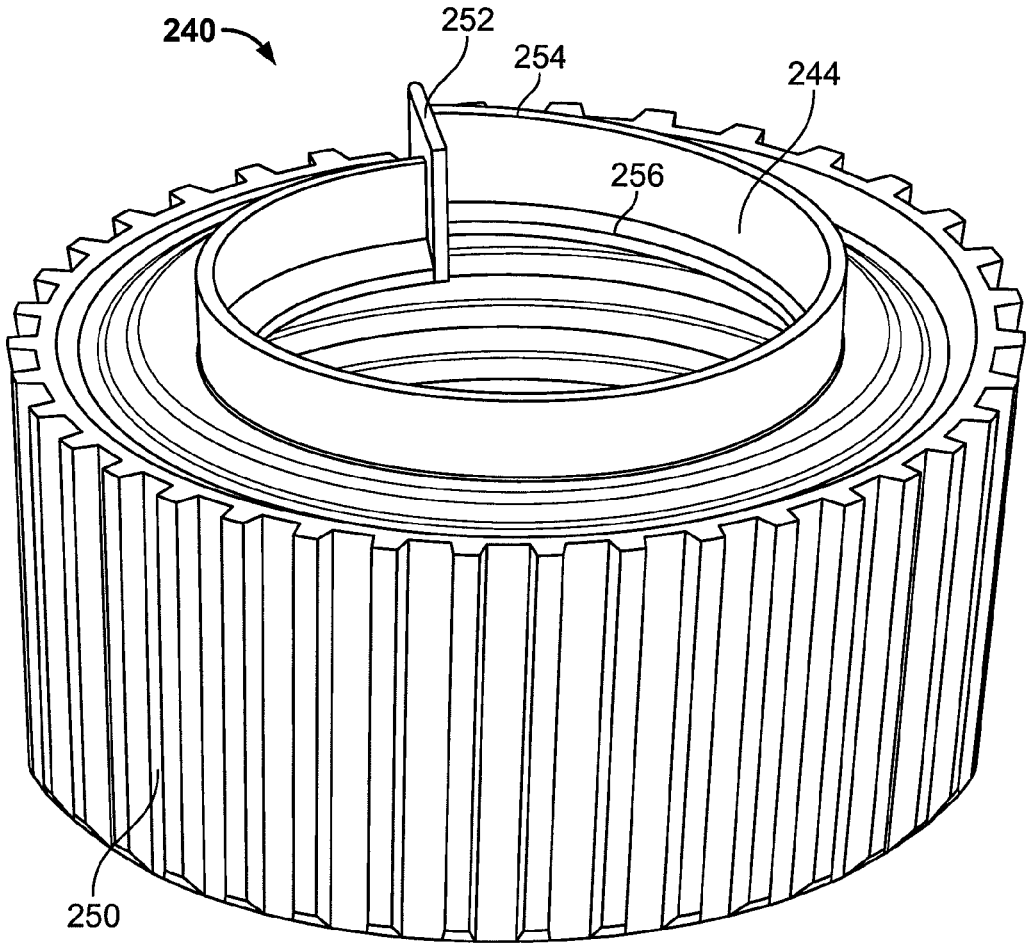
FIG. 10 is a perspective view of the collar of the variable arc nozzle of FIG. 8.

As shown in FIGS. 9 and 10, the collar 240 is also generally cylindrical in shape and has complementary internal threading to allow the collar 240 to be threadedly mounted onto the base 220. The collar 240 includes a central hub 244 that defines an opening therethrough. The collar 240 and deflector 280 engage one another, as described further below, to allow variable arc water distribution by the nozzle 210. Further, the collar 240 and split ring 260 preferably engage one another to control the flow of water to the deflector 280, as described further below. The collar 240 has a grippable outer wall 250 that may be rotated by a user to adjust the arcuate span of water distribution.

As shown in FIG. 10, the central hub 244 of the collar 240 has an internal spiral rim 256 that defines approximately one 360 degree helical revolution, or turn, with axially offset ends. This internal spiral rim 256 preferably engages the helical ring 260. The central hub 244 extends upward to form a raised spiral edge 254, which also defines approximately one 360 degree helical revolution, or turn, with axially offset ends. The raised spiral edge 254 engages a corresponding spiral underside surface 284 of the deflector 280.

As shown in FIG. 9, the deflector 280 has a generally frusto-conical shape with an enlarged head portion 281 and a lower stem portion 283 that extends into two prongs 282, similar to the deflector 80 described above and shown in FIG. 2. During assembly, the prongs 282 of the deflector 280 are inserted through the central hub 244 of the collar 240 and lock with the central hub 234 of the base 220. The nozzle base 220 and the deflector 280 are thereby fixed with respect to one another. The collar 240, however, is rotatable with respect to the base 220 and the deflector 280.

As shown in FIG. 9, the deflector 280 has a spiral underside surface 284 that engages the raised spiral edge 254 of the collar 240. The spiral underside surface 284 defines approximately one 360 degree helical turn, or revolution, where the ends of the helical turn are axially offset and joined by a stop 286. The collar 240 may be rotated through approximately one 360 degree helical turn with respect to the deflector 280 with a stop 252 of the collar 240 engaging the stop 286 of the deflector 280 to prevent further rotation. Further, the nozzle 210 preferably includes a bore 294 to permit use of an adjustment member to control a flow rate adjustment device.

The adjustment of the arcuate span is similar to that described above for the first and second embodiments. The raised spiral edge 254 of the collar 240 and the underside surface 284 of the deflector 280 engage one another to define the arcuate extent of the slot 290, which determines the arcuate span of water distribution. More specifically, the arcuate span is determined by the position of the raised spiral edge 254 of the collar 240 relative to the complementary helical underside surface 284 of the deflector 280. FIG. 8 shows the arcuate slot 290 closed on the left and open on the right of the figure. Unlike the first two embodiments shown in FIGS. 1-7, the nozzle 210, as shown in FIGS. 8 and 9, does not include a lower arcuate slot, but may be modified to include a lower arcuate slot for close in water distribution.

The matched precipitation rate results from the use of the split ring 260 that inter-fits with the collar 240 and the deflector 280. More specifically, as shown in FIG. 8, the split ring 260 engages a spiral edge 288 of the deflector 280 in the flow path beneath the arcuate slot 290. The spiral edge 288 and the split ring 260 define approximately a 360 degree spiral, or helical turn or revolution. As seen on the left side of FIG. 8, the spiral edge 288 of the deflector 280 contacts the internal spiral rim 256 of the collar 240 above the top of the notches 262, thereby blocking the flow path. In contrast, as seen on the right side of FIG. 8, the internal spiral rim 256 is spaced below the top of the notches 262, thereby allowing proportional water flow through exposed notches 262 (described in greater detail below) of the split ring 260 to the arcuate slot 290.

As seen in FIG. 9, the split ring 260 includes a series of spaced notches 262 disposed along its length and through which water must flow from the collar 240 to the deflector 280 for distribution to a selected arcuate area. As the collar 240 is rotated to select the arc, the number of notches 262 in the flow path changes. As the arc is increased, a greater number of notches 262 are disposed in the flow path, and conversely, if the arc is decreased, fewer notches 262 lie in the flow path. In this way, a matched precipitation rate can be achieved by proportioning the flow through the deflector 280, in accordance with the extent of the arcuate span.

The width and number of the notches 262 may be varied according to filtering requirements and flow demands. The width of the notches 262 is preferably sized greater than the filter size, which is preferably on the order of 0.02 inches, to avoid blockage of the notches 262. The number of notches 262 is preferably varied to accommodate the flow demand of nozzles designed for different throw radiuses with the number of notches 262 increasing as the intended throw radius increases. For example, a nozzle 210 may have 10 notches for an 8 foot radius of throw, 15 notches for a 10 foot radius of throw, 22 notches for a 12 foot radius of throw, and a continuous slot for a 15 foot radius of throw.

Initially, pressurized water flows from a source and through the flow passages 236 of the base 220. The water then flows through exposed notches 262 of the split ring 260, the number of exposed notches 262 depending on the extent of the arcuate span selected. The water then flows through the arcuate slot 290 and impacts the underside 284 of the deflector 280, which redirects the water to desired terrain at a predetermined distance about the nozzle 210.

Figure 11:
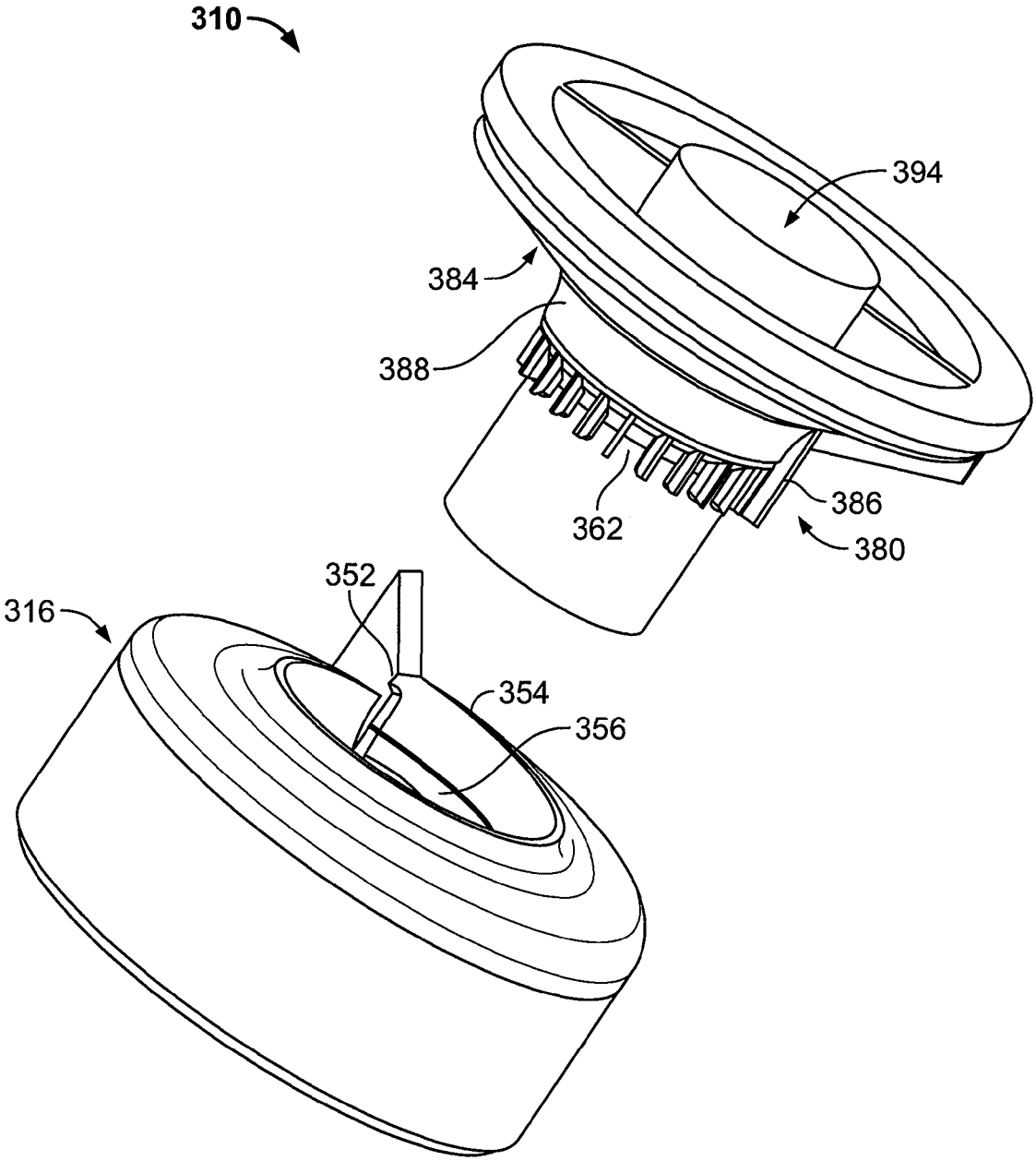
FIG. 11 is an exploded perspective view of a fourth embodiment of a variable arc nozzle embodying features of the present invention to provide an improved uniform precipitation rate.
Figure 12:
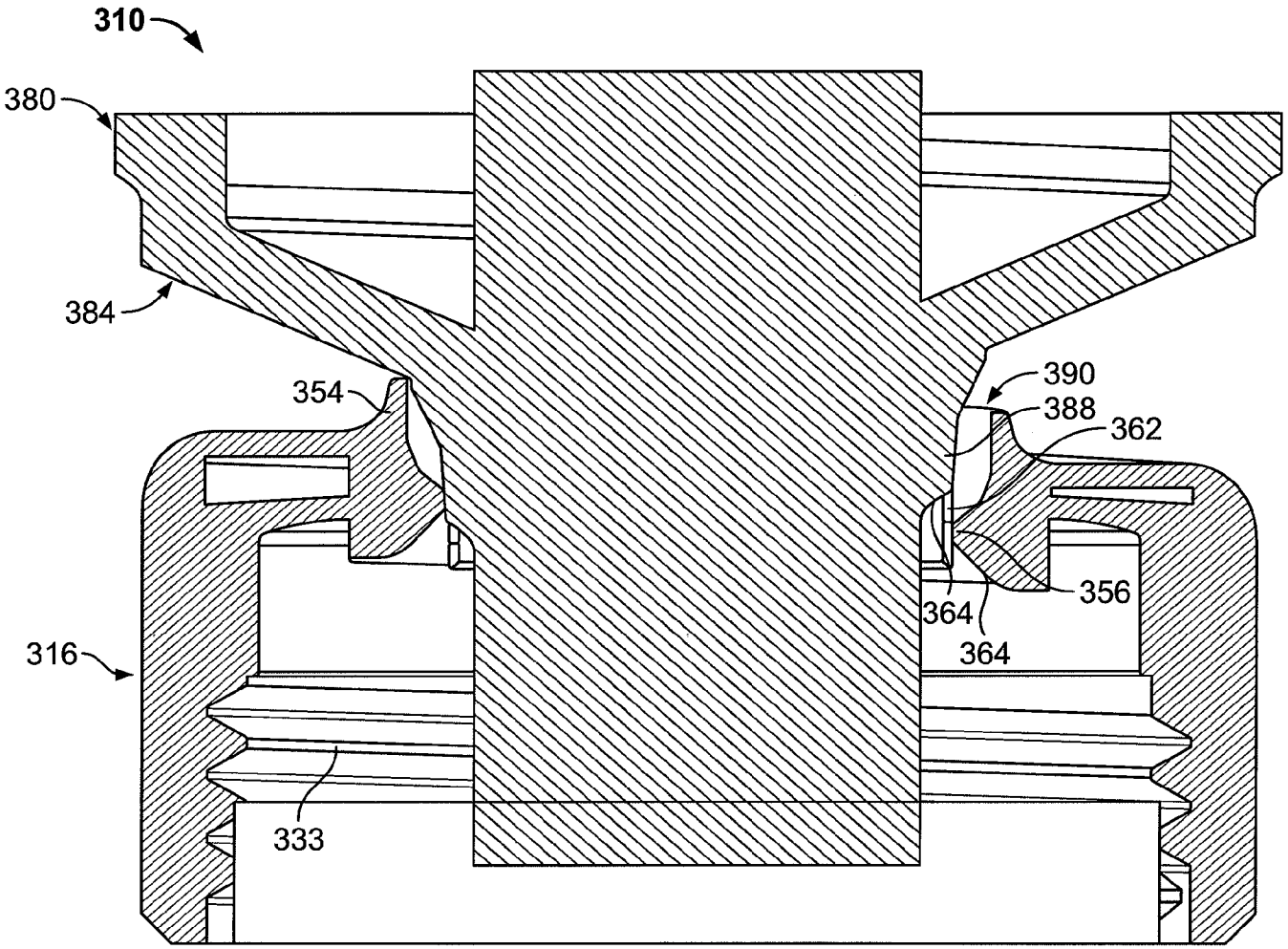
FIG. 12 is a cross-sectional view of the variable arc nozzle of FIG. 11.

FIGS. 11 and 12 depict a fourth embodiment of the variable arc nozzle 310 that also provides a matched precipitation rate. The fourth embodiment does not use a separate split ring 260. Instead, the deflector 380 has an integral series of spaced notches 362 molded into the deflector 380 with the notches 362 disposed in a spiral beneath a spiral edge 388 of the deflector 380. This molding saves cost and simplifies assembly by eliminating the need for separate and additional pieces. As should be evident, the matched precipitation rate features of the third and fourth embodiments, such as the split ring 260 and notches 362, may also be used in other embodiments described herein.

The fourth embodiment operates in essentially the same manner as described above for the third embodiment to restrict flow and maintain a relatively constant precipitation rate. The nozzle body 316 includes internal threading 333 for mounting onto a base, such as the base 220 shown in FIG. 9. The nozzle body 316 is rotatable with respect to the deflector 380 until a stop 352 on the nozzle body 316 engages a stop 386 on the deflector 380. The nozzle body 316 includes a raised spiral edge 354 that engages the helical underside surface 384 of the deflector 380 to define an arcuate slot 390. The nozzle body 316 also includes an internal spiral rim 356 for helical engagement with notches 362 to proportion the flow through the deflector 380. In addition, as shown in FIG. 11, the deflector 380 preferably includes a bore 394 to accommodate an adjustment member for setting a flow rate adjustment device.

Pressurized water flows from a source through the nozzle body 316. Water then flows through exposed notches 362, the number of exposed notches 362 depending on the extent of the arcuate span selected by the user. As the nozzle body 316 is rotated to select the arcuate span, the number of exposed notches 362 either increases or decreases, thereby proportioning the flow. After passing through the notches 362, the water flows through an arcuate slot 390 and impacts the underside 384 of the deflector 380, which redirects the water to terrain at a predetermined distance about the nozzle 310. In the fourth embodiment, the nozzle body 316 and the deflector 380 have been designed to minimize the loss of water velocity and energy as water flows through the flow path. More specifically, the deflector 380 and nozzle body 316 have rounded surfaces 364 to reduce velocity and energy dissipation as water impacts and is redirected by these surfaces 364.

Figure 13:
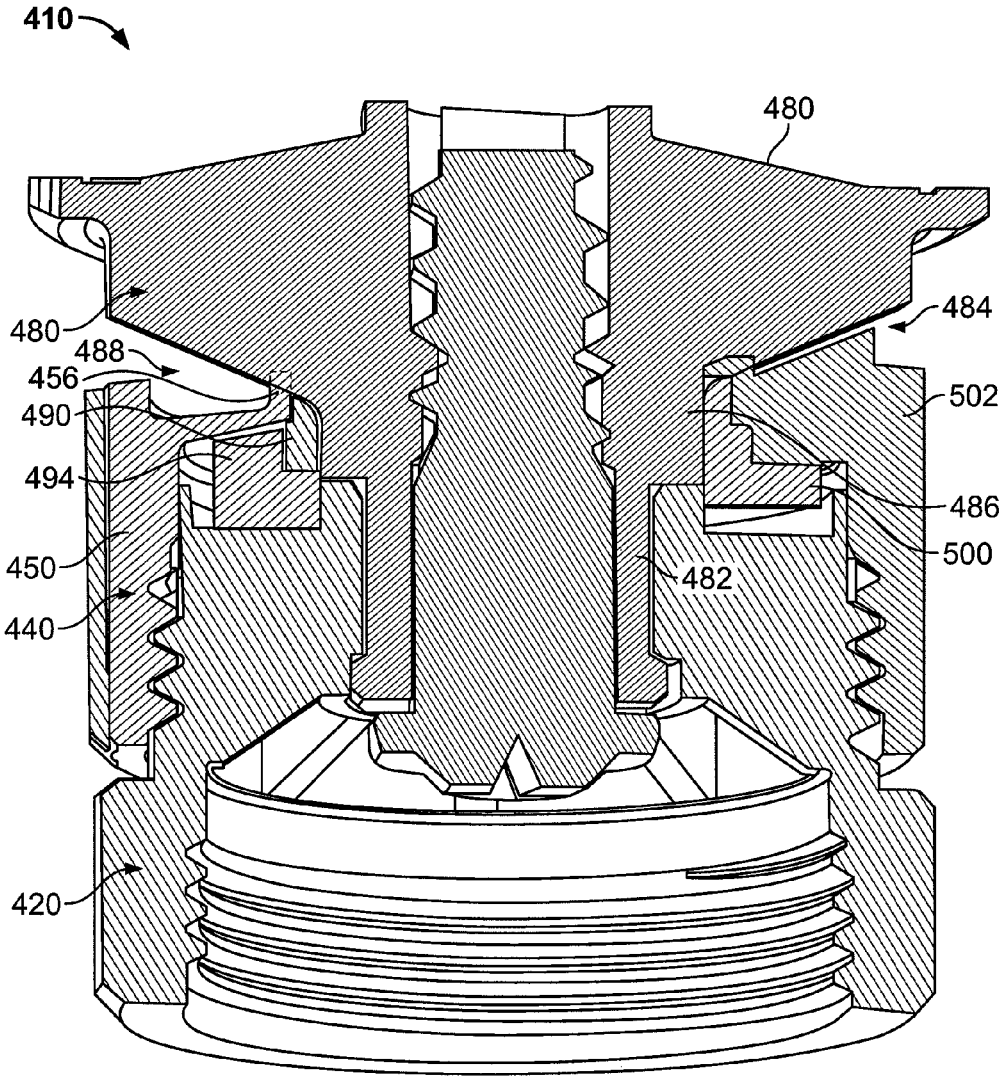
FIG. 13 is a cross-sectional view of a fifth embodiment of a variable arc nozzle embodying features of the present invention to improve water distribution at the edges of the water distribution arc.

FIG. 13 shows a fifth preferred embodiment of a nozzle 410. The nozzle 410 employs improved edge "fins" to enhance and create uniform water distribution at the edges of the arcuate span. The nozzle 410 includes a base 420, collar 440, and deflector 480. As with other embodiments, the collar 440 and the deflector 480 have spiral surfaces that engage one another for adjustably setting the arcuate span of the nozzle 410.

The base 420, collar 440, and deflector 480 also each include edge fins that result in more even water distribution at the edges of the arc. The edge fins collectively define the two edges of the arcuate span. More specifically, the edge fins on the base 420 and the deflector 480 cooperate to define the flow path for one edge of the water distribution arc, i.e., on the left of FIG. 13, while the edge fins on the collar 440 define the flow path for the second edge, i.e., on the right of FIG. 13.

Figure 14:
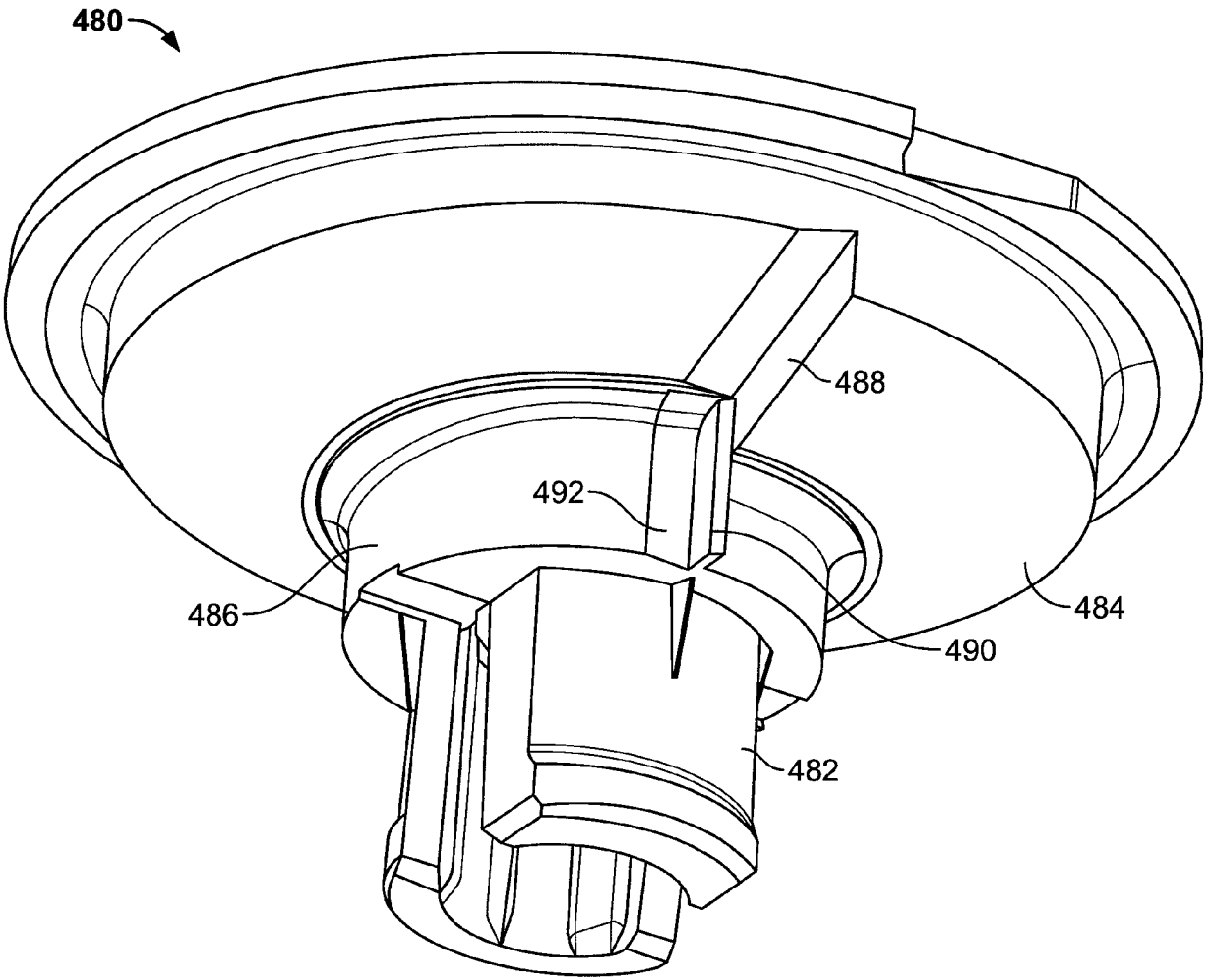
FIG. 14 is a perspective view of the deflector of the variable arc nozzle of FIG. 13.

One set of edge fins (the set shown on the left of FIG. 13) is located on, and is defined by, the deflector 480 and the base 420. As shown in FIG. 14, the deflector 480 has a spiral underside surface 484 that deflects water directed against it outward from the nozzle 410 and to desired terrain surrounding the nozzle 410. The deflector 480 also has two substantially concentric stem segments 482 and 486 extending longitudinally in series from the center of the spiral underside surface 484. The distal stem segment 482 preferably has two arcuate fingers that can be deflected toward one another for insertion into the base 420 and, once inserted, they bias outward in their static position to hold the deflector 480 in fixed engagement with the base 420. The proximate stem segment 486 is larger in diameter than the distal stem segment 482, lies between the spiral underside surface 484 and the distal stem segment 482, and engages the rotatable collar 440 to define the extent of the arcuate span of water distribution.

The deflector 480 has an upper edge fin 488 disposed on the spiral underside surface 484 and a lower edge fin 490 disposed on the proximate stem segment 486. As shown in FIG. 14, the upper deflector edge fin 488 extends between the inner circumference and outer circumference of the spiral underside surface 484. The lower deflector edge fin 490 extends vertically from the bottom to the top of the proximate stem segment 486.

Together, the upper edge fin 488 and the lower edge fin 490 project radially outwardly from deflector 480 to define part of one edge boundary of the arcuate span. These edge fins 488 and 490 are aligned end-to-end so as to define a relatively long axial boundary to channel the flow of water exiting the nozzle 410. More specifically, the edge fins 488 and 490 extend along the flow path from the flow passages 436 in the base 420 (FIG. 15) to the upper, outer circumference of the spiral underside surface 484. This long axial boundary reduces the tangential components of flow along the boundary formed by the edge fins 488 and 490, producing a well-defined edge to the arcuate span. In addition, the spiral underside surface 484 and proximate stem segment 486 preferably define a channel 492 extending along the length of, and adjacent to, the edge fins 488 and 490. This channel 492 further enhances and defines the first edge by columnating the water flow and by allowing an additional volume of flow along the first edge.

Figure 15:
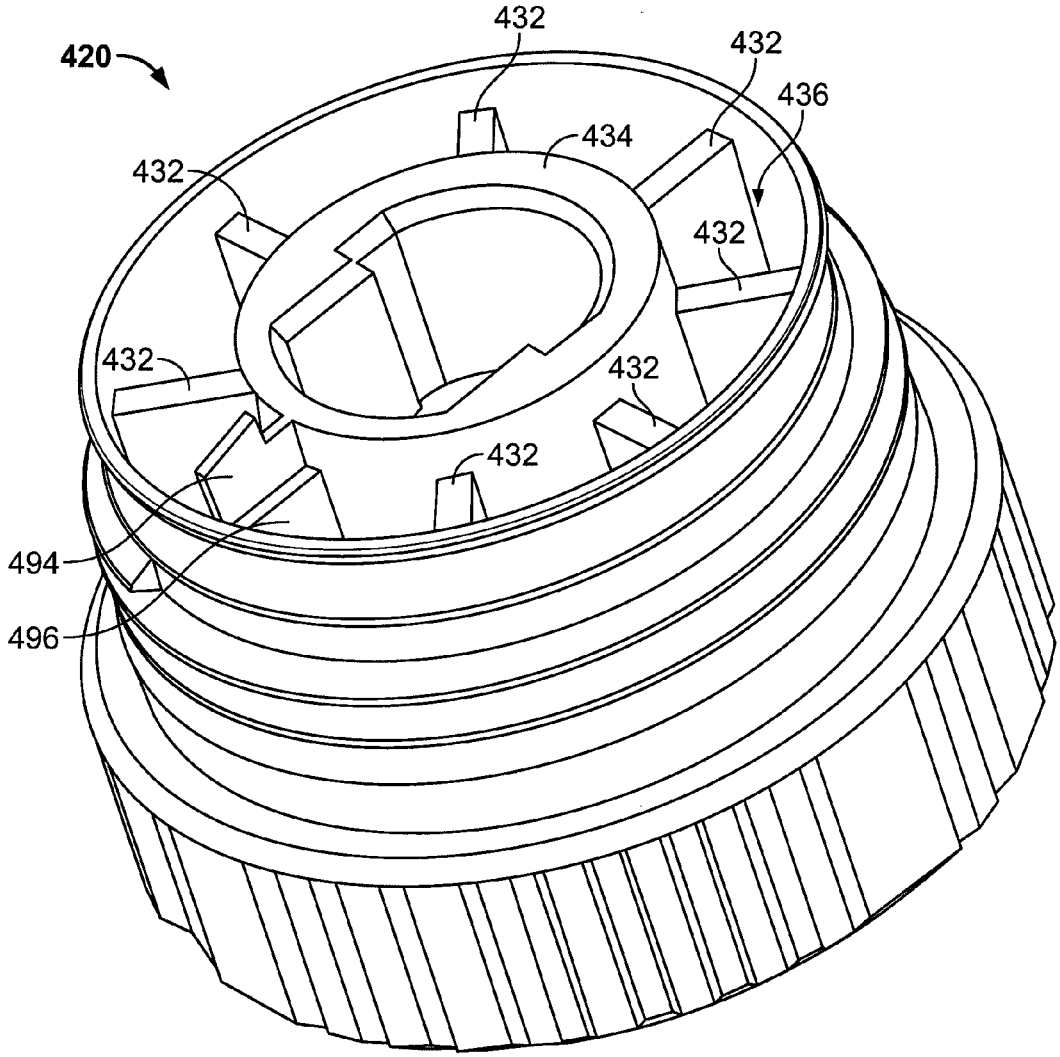
FIG. 15 is a perspective view of the base of the variable arc nozzle of FIG. 13.

This long axial boundary is further lengthened by a base edge fin 494 projecting upwardly from a rib 496 of the base 420 (FIGS. 13 and 15). The base edge fin 494 is preferably L-shaped and cooperates with the lower deflector edge fin 490 and with the underside of the collar 440, as illustrated in FIG. 13. The base edge fin 494 minimizes tangential flow between the rib 496 and the proximate stem segment 486. In effect, the base edge fin 494 extends the rib 496 and extends the axial boundary from the top of the rib 496 to the outer circumference of the spiral underside surface 484.

Also, as shown in FIGS. 13-15, the lower deflector edge fin 490 cooperates with the base edge fin 494 to extend the boundary edge in a radial direction (in addition to the axial direction). As shown in FIG. 14, the lower deflector edge fin 490 extends radially outwardly from the proximate stem segment 486. As shown in FIG. 15, the base edge fin 494 extends radially outwardly from the central hub 434 of the base 420 toward the outer wall 450 of the collar 440. The lower deflector edge fin 490 extends radially outwardly so that it preferably engages the internal spiral rim 456 of the collar 440 and so that it preferably engages the base edge fin 494 (FIG. 13). By extending the lower deflector edge fin 490 radially so that it engages the collar 440 and the base edge fin 494, water cannot leak into the gaps that would otherwise exist between the base 420, collar 440, and deflector 480. Water leaking into such gaps would otherwise provide a tangential flow component that would interfere with water exiting the nozzle 410. The lower deflector edge fin 490 and the base edge fin 494 therefore minimize this tangential component.

The second set of edge fins is located on the collar 440. The second set of edge fins defines the flow path for water exiting the nozzle 410 along the second edge, i.e., along the edge boundary shown in the right of FIG. 13. The edge fins on the collar 440 reduce the tangential component of water flow that interferes with water exiting the nozzle 410 along that second edge.

Figure 16:
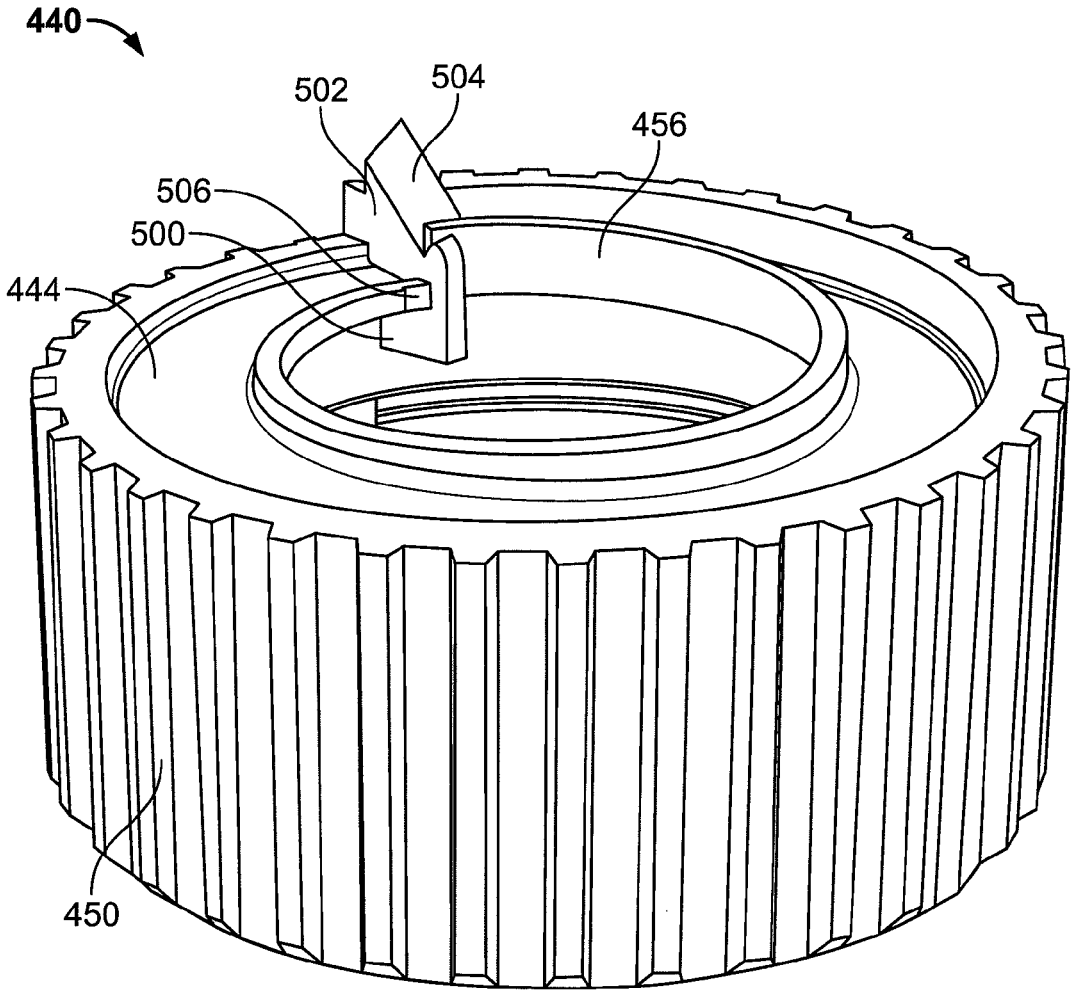
FIG. 16 is a top perspective view of the collar of the variable arc nozzle of FIG. 13.
Figure 17:
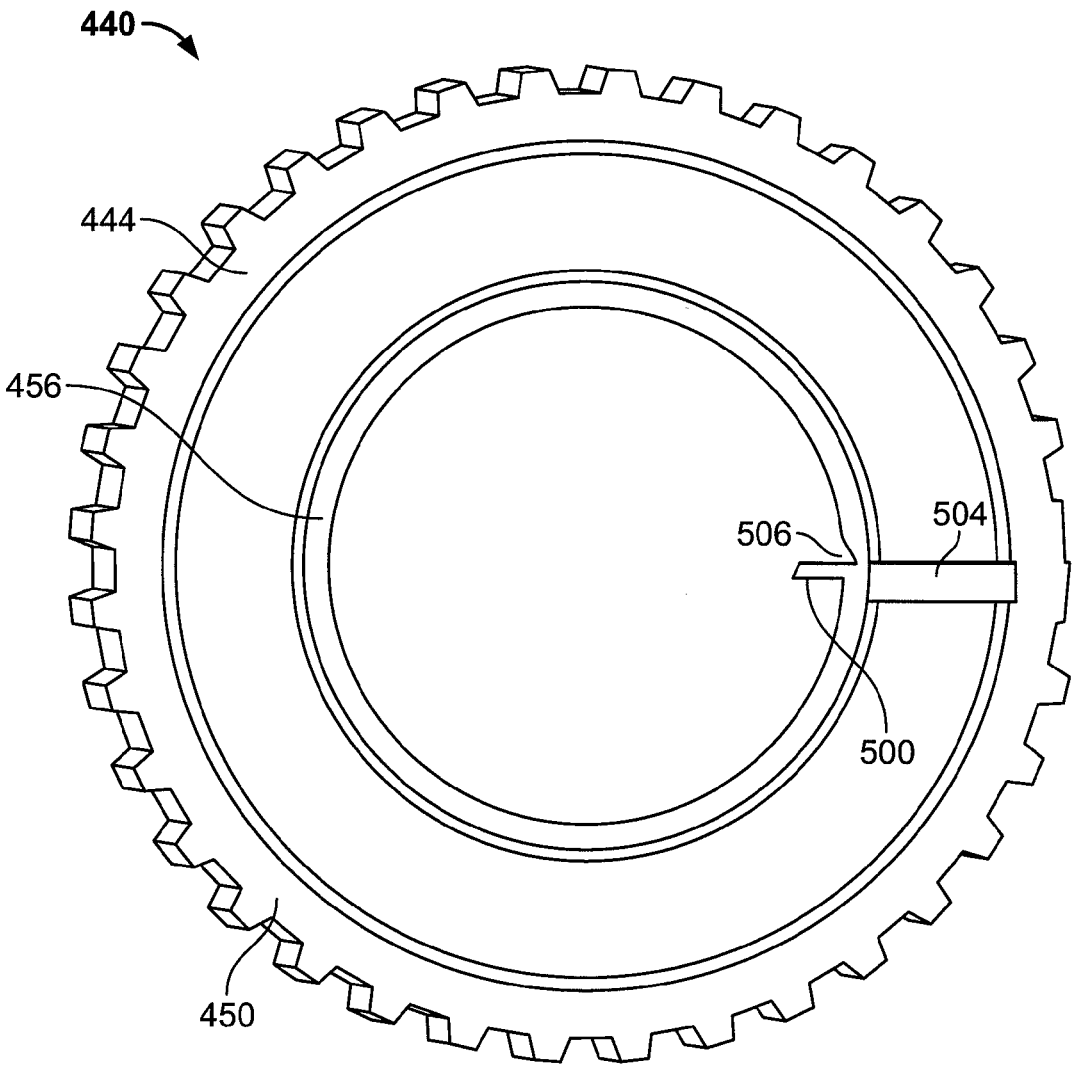
FIG. 17 is a top view of the collar of the variable arc nozzle of FIG. 13.
Figure 18:
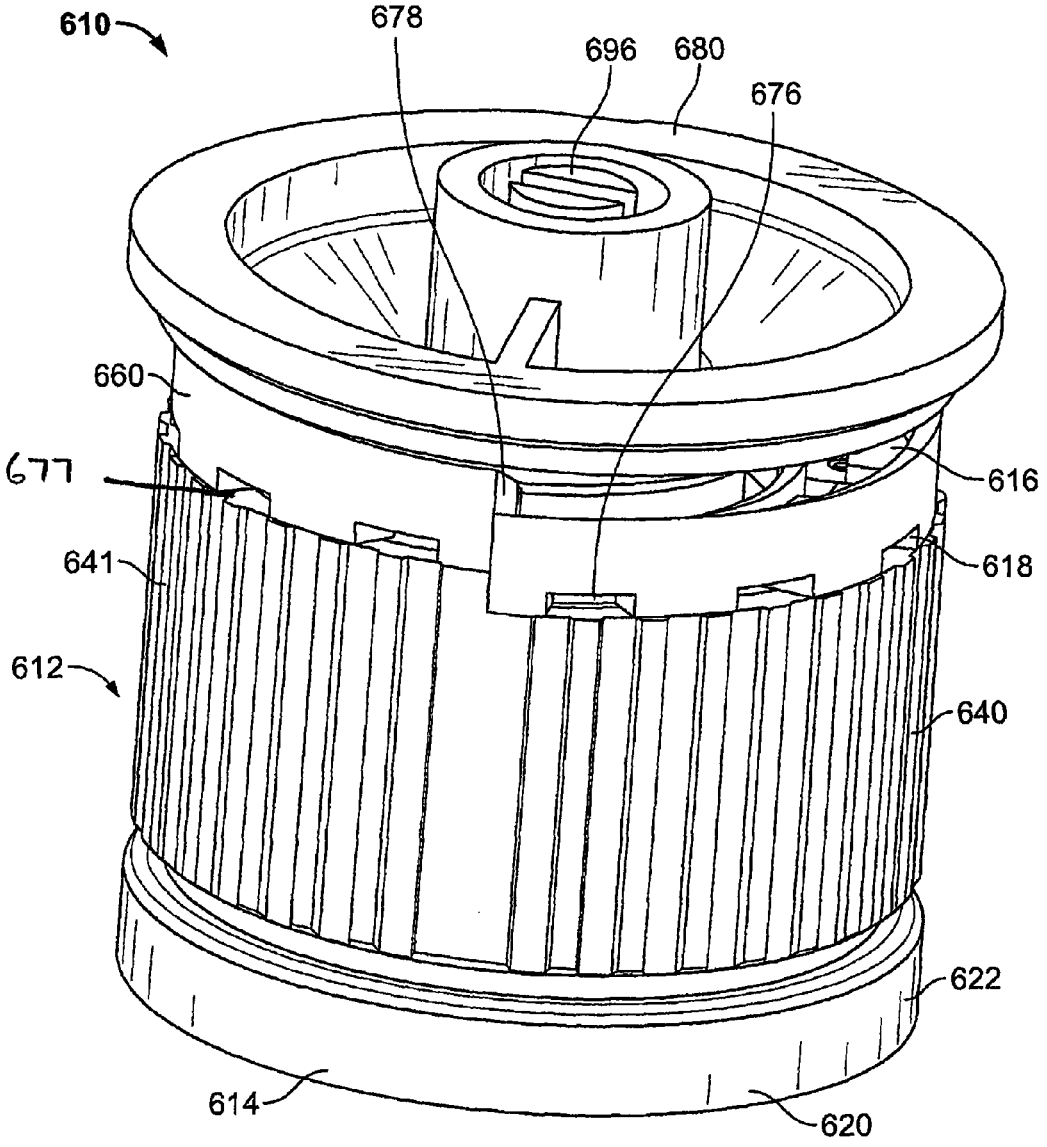
FIG. 18 is a perspective view of a sixth embodiment of a variable arc nozzle embodying features of the present invention.

As shown in FIGS. 16 and 17, the collar 440 includes an annular central band 444 that defines an opening therethrough. The annular band 444 is encircled by the outer wall 450 that may be engaged by a user to be manually rotated to adjust the extent of the arcuate span. The internal rim 456 of the collar 440 defines a spiral for engagement with the deflector 480.

The collar edge fins include a first collar edge fin 500 located primarily on the underside of the annular band 444 that wraps around the annular band 444 and extends into a second collar edge fin 502 located on the top of the band 444. In other words, as shown in FIGS. 13 and 16, the first collar edge fin 500 projects downwardly from the underside of the band 444, extends from a point near the outer wall 450 of the collar 440 radially inwardly to engage the proximate stem segment 486 of the deflector 480, and extends upwardly along the proximate stem segment 486. The second collar edge fin 502 projects upwardly from the top of the band 444 and extends from the outer wall 450 radially inwardly to meet the first collar edge fin 500. The second collar edge fin 502 has an upper inclined surface 504 for engaging the spiral underside surface 484 of the deflector 480.

The first and second collar edge fins 500 and 502 extend the second boundary edge both axially and radially so that water flows upwardly along the collar edge. In the axial direction, the second boundary edge extends from just above the ribs 432 of the base 420 to the outer end of the second collar edge fin 502. In the radial direction, the first collar edge fin 500 extends the second boundary edge from the proximate stem segment 486 of the deflector 480 to a point near the outer wall 450 of the collar 440. In this manner, the first and second collar edge fins 500 and 502 reduce axial and radial bypass flow at the collar edge of the nozzle 410.

During operation, the base 420 and deflector 480 are fixed relative to the rotating collar 440. As shown in FIG. 13, the base, collar, and deflector edge fins are sized so as not to interfere with rotatable adjustment of the collar 440 to define the extent of the arcuate span. Also, the base, collar, and deflector edge fins can be used with other embodiments of the nozzle described herein.

The nozzle 410 is preferably assembled so that there is a tight interference fit to prevent radial bypass flow. More specifically, the nozzle 410 is assembled so that there is a tight interference fit between the lower deflector edge fin 490 and the internal spiral rim 456 of the collar 440. Also, the nozzle 410 is assembled so that that there is a tight interference fit between the first collar edge fin 500 and the proximate stem segment 486 of the deflector 480.

These interference fits are preferably accomplished through the use of the channel 492 adjacent to the lower deflector edge fin 490 (FIG. 14) and through the use of a notch 506 in the internal spiral rim 456 of the collar 440 (FIGS. 16 and 17). During assembly, the channel 492 provides sufficient clearance for the inwardly projecting first collar edge fin 500. Similarly, during assembly, the notch 506 provides sufficient clearance for the outwardly projecting lower deflector edge fin 490. Upon rotation, the channel 492 and notch 506 allow the deflector 480 and the collar 440 to gradually deform these respective fins 500 and 490 into their sealing positions.

FIGS. 18-22 illustrate a sixth preferred form of the variable arc nozzle 610. The variable arc nozzle 610 generally includes: a deflector 680 having an underside surface 684 configured to redirect fluid outwardly therefrom; a nozzle body 612 having an inlet 614 for receiving fluid from a source, a primary outlet 616 and a secondary outlet 618 for directing fluid outwardly from the nozzle 610, and a helical engagement surface 644 for rotatably engaging the deflector 680 to form a helical valve 691 that is adjustable in size between a fully open position and a fully closed position; a first flow path from the inlet 614 through the helical valve 691 when in an open position to the underside surface 684 of the deflector 680; and a second flow path from the inlet 614 through the helical valve 691 when in an open position to the secondary outlet 618. This variable arc nozzle 610 also preferably can be adjusted to virtually any arc between 0° and 360°.

In one preferred form, it is similar to the first two embodiments described above and includes the primary outlet 616 for distant irrigation and the secondary outlet 618 for close-in irrigation. Unlike the first two embodiments, however, the variable arc nozzle 610 preferably includes a helical valve 691, in the form of an arcuate slot, that controls the arcuate span for both distant irrigation and close-in irrigation. This helical valve 691 can be seen in FIG. 19 where it is open on the left side of the figure and closed on the right side of the figure. The helical valve 691 also preferably includes additional structure for matching the precipitation rate of fluid flowing through the valve 691 when in an open position regardless of the adjusted size of the helical valve.

Figure 20:
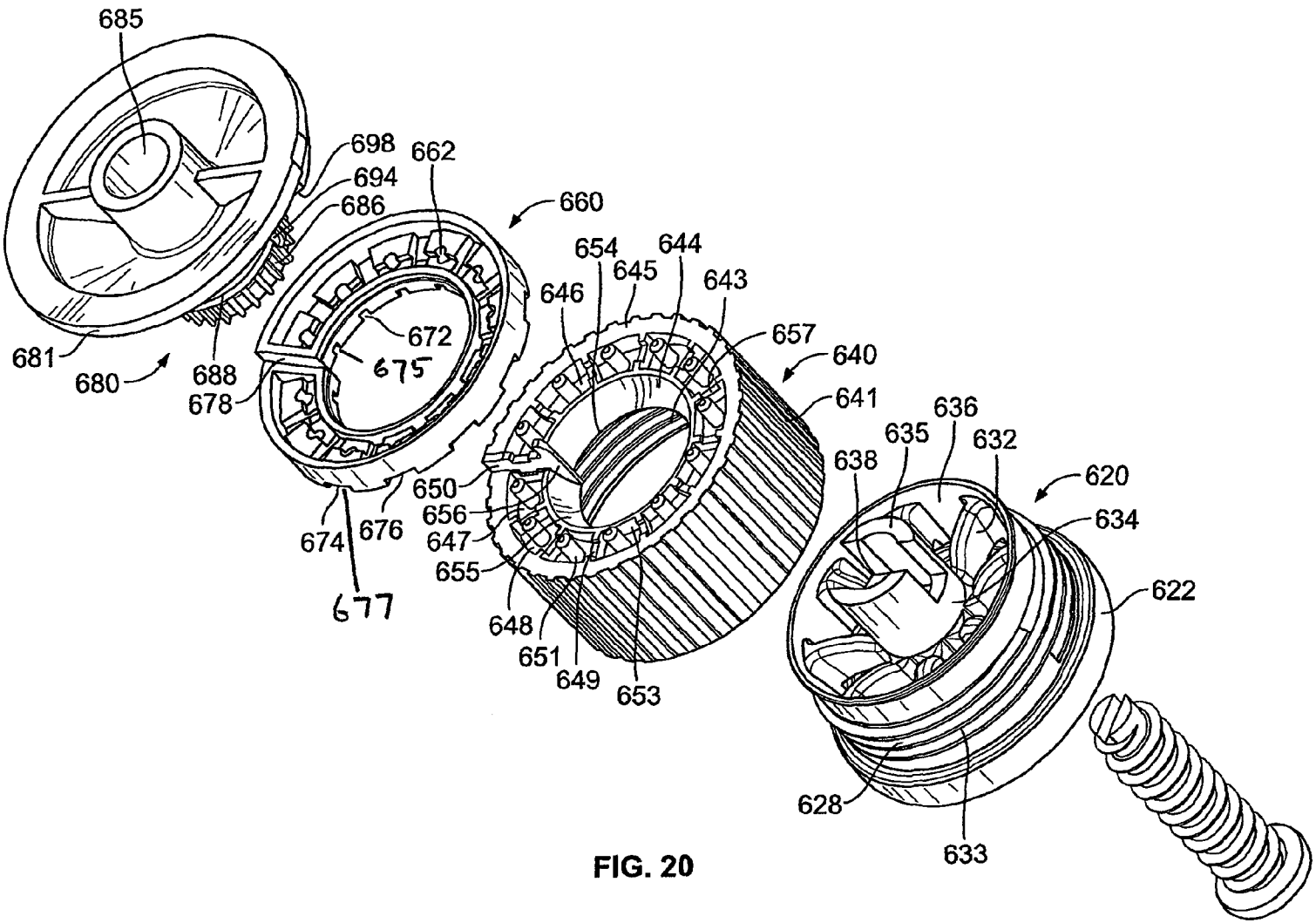
FIG. 20 is a top exploded perspective view of the variable arc nozzle of FIG. 18.
Figure 21:
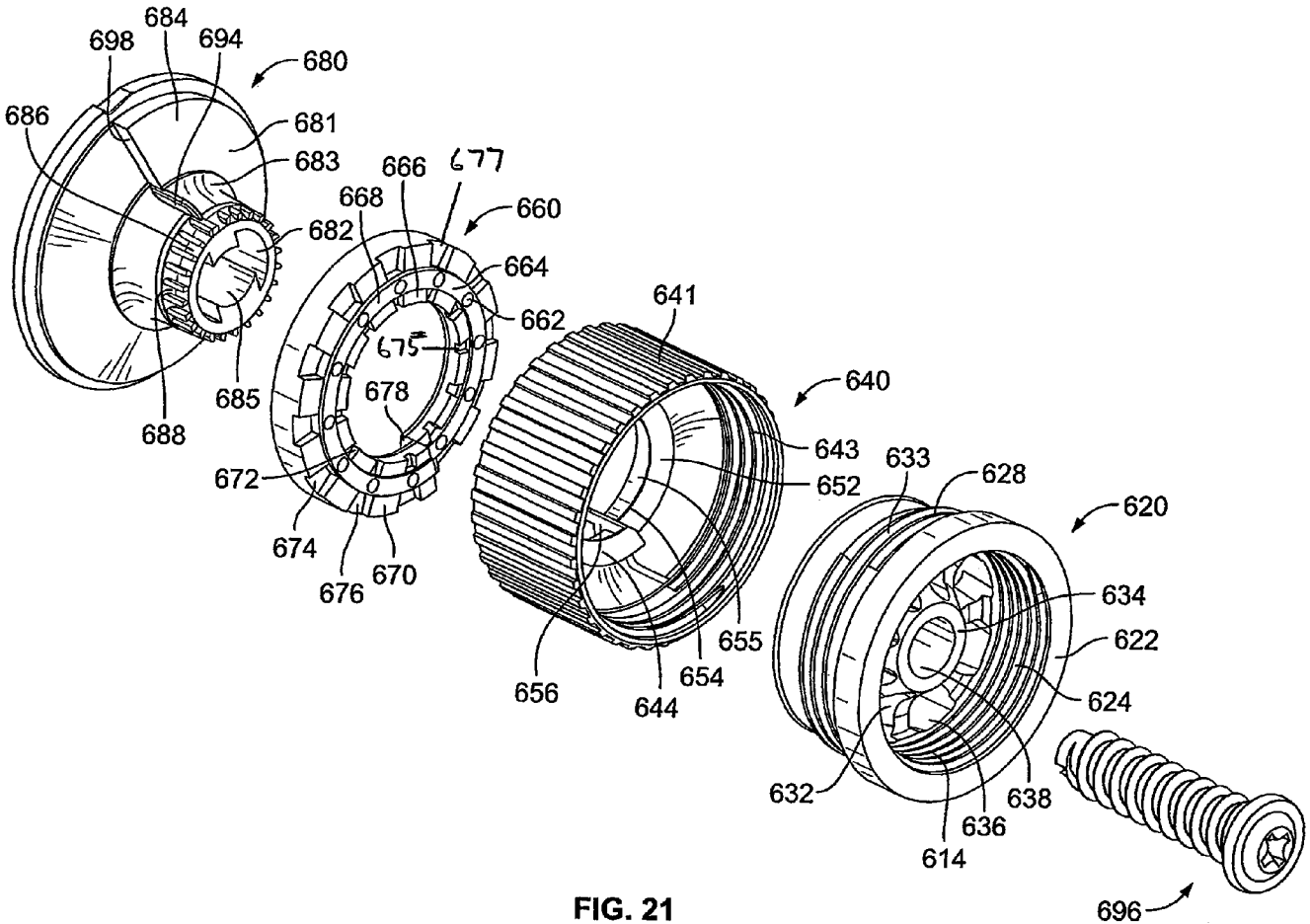
FIG. 21 is a bottom exploded perspective view of the variable arc nozzle of FIG. 18.

As best shown in FIGS. 20-21, the variable arc nozzle 610 preferably includes several components—a base 620, a collar 640, a cover 660, the deflector 680, and a flow rate adjustment screw 696. As described further below, some of these components preferably include complementary engaging helical surfaces coordinate with the desired arcuate extent of irrigation. Although FIGS. 20-21 show a preferred form of collar 640 and cover 660 as separate, these two components may instead be formed as one integral component.

The base 620 is preferably generally cylindrical with internal threading 624 for mounting a lower end 622 onto a fluid source, although the base 620 may include alternative mounting structure. The base 620 also includes an outer cylindrical wall 628, a central hub 634, and ribs 632 for interconnecting the outer wall 628 to the central hub 634. The ribs 632 define flow passages 636 therethrough to allow fluid flow from the fluid source to downstream portions of the nozzle 610.

The base 620 includes structure for engagement with other components of the nozzle 610. For example, the central hub 634 preferably includes two arcuate segments 635 that project downstream from the central hub 634 for interlocking engagement with the deflector 680, as described further below. These arcuate segments 635 assist in maintaining the base 620 and deflector 680 in a fixed arrangement with respect to one another. The base central hub 634 defines a bore 638 for reception of the flow rate adjustment screw 696 therein. In addition, base 620 preferably includes external threading 633 for threaded engagement with the collar 640 to allow the collar 640 to rotate with respect to the base 620.

The collar 640 is rotatable with respect to the stationary base 620 and deflector 680 to set the desired water distribution arc. The collar 640 preferably includes a knurled outer wall 641 to provide a gripping surface for rotation by the user. The collar 640 also preferably includes internal threading 643 for engagement and rotation with respect to the external threading 633 of the base 620.

Figure 19:
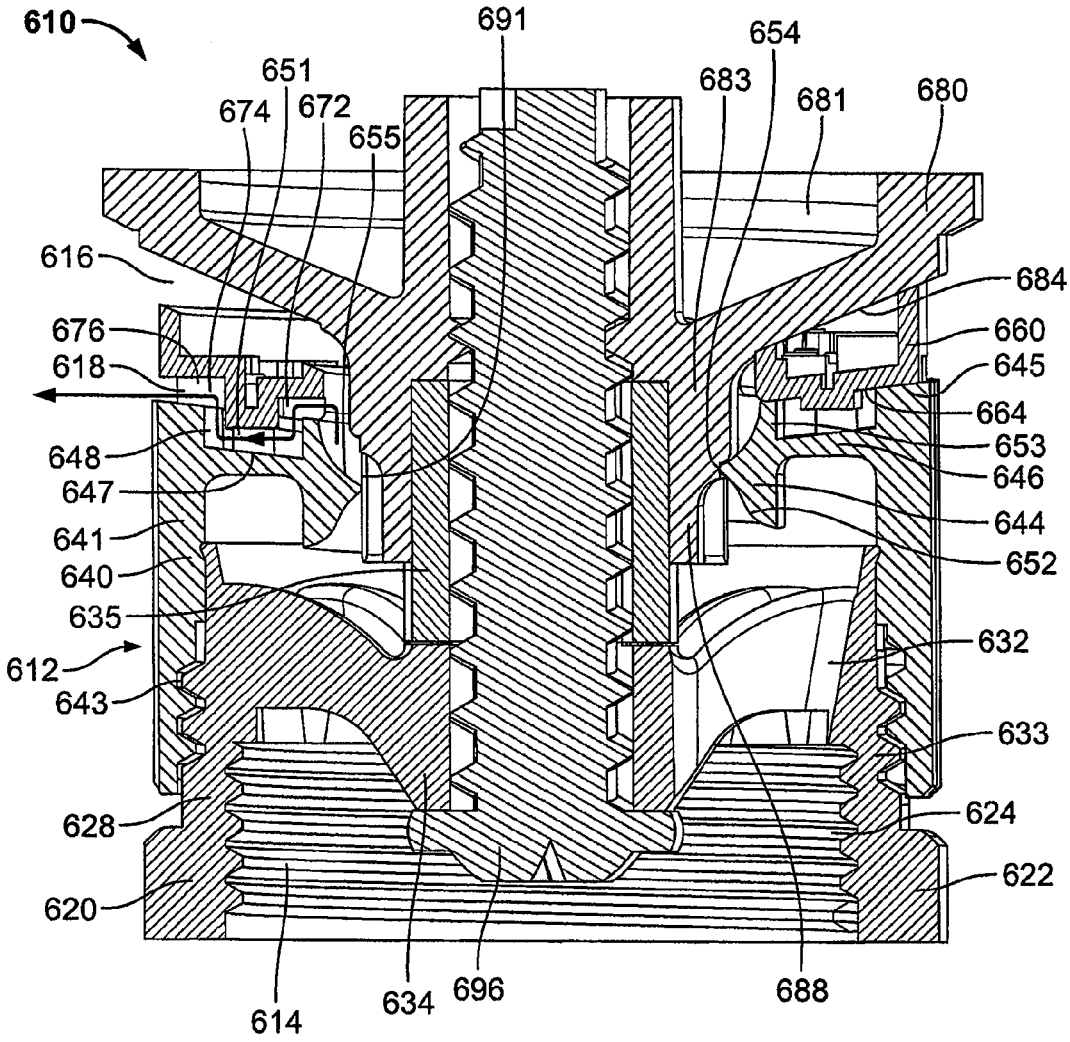
FIG. 19 is a cross-sectional view of the variable arc nozzle of FIG. 18.

As can be seen in FIGS. 19-21, the collar 640 also preferably includes several helical portions. For example, in one preferred form, the outer wall 641 defines a top helical surface 645 with axially offset ends. In addition, the collar 640 defines an inner helical central hub 644, which engages the deflector 680 to provide the arcuate setting for the primary and secondary outlets 616 and 618. Further, the collar 640 preferably includes an intermediate helical portion 646 disposed radially between the outer wall 641 and the inner helical central hub 644. The intermediate portion 646 preferably includes structure for fastening the collar 640 to the cover 660.

FIG. 20 best shows the top surface 647 of helical intermediate portion 646. The top surface 647 preferably includes a number of recesses 648 with each recess 648 bounded by notched radial walls 649 that connect the outer wall 641 to the central hub 644. The radial walls 649 are notched for engagement with the cover 660, as described further below. In one preferred form, the intermediate portion 646 includes twelve recesses 648. The recesses 648 are disposed circumferentially about the intermediate portion 646 in a helical manner with two axially offset recesses 648 at the respective ends of the helix defining a notched boundary wall 650 between them. Each recess 648 also preferably includes a pin 651 projecting downstream from the top surface 647 for engagement with the cover 660, as described further below.

As shown in FIGS. 19-21, the central hub 644 forms the innermost radial portion of the collar 640. The underside surface 652 is preferably smoothly contoured and extends from an inner wall 653 inwardly and in a downstream direction to an innermost radial edge 654. Similarly, the top surface 655 is preferably smoothly contoured and is sized for engagement with a correspondingly shaped deflector fin 694, as described further below. The top surface 655 extends from the innermost radial edge 654 outwardly and in a downstream direction to the inner wall 653.

The helical ends of the central hub 644 define a collar fin 656, as shown in FIGS. 20-21. The collar fin 656 defines, in part, a first edge of the flow for fluid flowing through the collar 640. It extends in both axial and radial directions to maintain fluid flow along the first edge. More specifically, it extends axially downstream from the collar 640 to guide fluid flowing along its length, and it extends inwardly radially to engage the deflector 680 to thereby limit tangential fluid flow. It is also aligned with and cooperates with a downstream fin 678 of the cover 660 for defining the first edge of flow for fluid flowing through the primary outlet 616.

One preferred form of cover 660 is shown in FIGS. 18-21. It is generally ring-shaped with axially offset ends to form one revolution of a helix. It is sized to engage the correspondingly-shaped helical top surface of the collar 640. The cover 660 preferably includes a number of apertures 662 that are each sized to receive one of the collar pins 651. As shown, in one preferred form, the cover 660 includes twelve apertures 662. The apertures 662 and pins 651 may engage one another in any one of various known fastening methods, such as by pressure fitting, ultrasonic welding, etc. In this manner, the cover 660 is preferably affixed to the collar 640, although it should be evident that other attachment methods are also available. Thus, the cover 660 rotates with the collar 640 when actuated by a user, while the base 620 and deflector 680 remain stationary.

As can best be seen in FIG. 21, in one preferred form, the helical underside surface 664 of the cover 660, which engages the collar 640, can be divided into three ring-like portions—an inner portion 666, a middle portion 668, and an outer portion 670. The middle portion 668 includes the apertures 662 for engagement with the collar pins 651. The middle portion 668 preferably projects axially beyond the inner and outer portions 668, 670, respectively, to form a helical plateau that is received in the ring of notches 657 formed in the collar radial and boundary walls 649 and 650. The inner portion 666 preferably includes inner grooves 672 defining, in part, inner flow channels, and the outer portion 670 preferably includes outer grooves 674 defining, in part, outer flow channels.

The collar 640 and the cover 660 engage one another to define the secondary outlet 618 for close-in irrigation. In one preferred form, the secondary outlet 618 includes twelve flow passages 676, each flow passage 676 defining a tortuous and divergent flow path. More specifically, fluid flows outwardly along an inner groove 672, then downwardly into the corresponding recess 648, then outwardly within the recess 648, then upwardly along the corresponding outer groove 674, and then outwardly from the nozzle 610, as described further below. Further, each flow passage 676 preferably diverges from a relatively small cross-sectional area at the proximal end to a relatively large cross-sectional area at the distal end. In other words, each flow passage inlet 675 is relatively small in cross-sectional area compared to the corresponding flow passage outlet 677.

The cover 660 also engages the deflector 680 to define the primary outlet 616 for relatively distant irrigation. The cover 660 includes a stepped wall 678 formed by the ends of the helix that defines an edge of the primary outlet 616. This stepped wall 678 operates to guide fluid flow along the first edge of a water distribution arc in a radially outward direction. As can be seen in FIGS. 20-21, this cover wall 678 is aligned with and cooperates with the collar fin 656.

As shown in FIGS. 19-21, the deflector 680 includes an upper head portion 681 for deflecting fluid directed against its helical underside 684 and a lower stem portion 683. The lower stem portion 683 preferably defines two arcuate apertures 682 sized for receiving the two arcuate segments 635 of the base 620 in interlocking engagement. As should be evident, other methods of interlocking engagement of base 620 and deflector 680 also may be used. The lower stem portion 683 also preferably defines a central bore 685 through which extends the flow rate adjustment screw 696.

The terminal end 688 of the stem portion 683 defines a series of axially extending notches 686 spaced circumferentially thereabout. As can best be seen in FIG. 21, the axial length of these notches 686 preferably increases in a helical manner as one proceeds about the circumference of the stem portion 683. In other forms, however, the notches 686 may each be fashioned of a uniform axial length, such as through the use of alternative molds with parting lines. Thus, the axial length is a matter of design convenience.

The number of exposed notches 686 in the flow path proportions the flow and provides a matched precipitation rate. More specifically, as the collar 640 is rotated to select the arc, the number of exposed notches 686 in the flow path increases as the size of the arc increases, while the number decreases as the size of the arc decreases. In this manner, these notches 686 provide for a matched precipitation rate regardless of the size of the water distribution arc selected by the user. That is, as the arc is changed, the rate of precipitation is matched.

As can be seen in FIG. 19, the terminal end 688 of the deflector 680 engages the collar 640 to define the helical valve 691, or arcuate slot. More specifically, the stem portion 683 of the deflector 680 engages the innermost radial edge 654 of the collar 640 to define the arcuate slot 691. Rotation of the collar 640 allows the user to fully open or fully close the valve 691, or to set it to a desired intermediate position. As described further below, fluid flows upwardly along the notches 686 exposed by the open portion of the arcuate slot 691.

As best shown in FIG. 21, the deflector 680 also preferably includes a fin 694 and a stepped wall 698 to define the second edge of the water distribution arc of the primary outlet 616. The fin 694 is disposed along the stem portion 683 to guide fluid flow along the second edge in an axial direction. The fin 694 is sized so that it extends axially and radially to engage a correspondingly-shaped portion of the collar 640—the central hub 644—as described further below. The stepped wall 698 is aligned with the fin 694 and is disposed along the deflector underside 684 to guide fluid along the second edge in a generally radially outwardly direction. The stepped wall 698 is formed by joining the ends of the helical underside surface 684 and forms an edge of the primary outlet 616.

In general operation, fluid flowing through the nozzle 610 flows along a single flow path up to the helical valve 691. As can be seen from FIG. 19, the helical valve 691 controls fluid flow through both the downstream primary and secondary outlets 616 and 618. Fluid continues past the helical valve 691 in an upwardly direction where most of it is then redirected by the deflector 680 through a primary outlet 616 for relatively distant irrigation. A relatively small portion of the fluid flowing past the helical valve 691, however, is siphoned off laterally through the said twelve flow passages 676 constituting the secondary outlet 618. As used herein, secondary outlet 618 may be used to refer to each of the twelve individual lateral outlets or may be used to collectively refer to the combination of the individual outlets.

More specifically, fluid initially flows upwardly from the source through the flow passages 636 defined by the ribs 632 of the nozzle base 620. Fluid then flows upwardly into the nozzle collar 640 and through the open arcuate portion of the helical valve 691. As fluid flows upwardly through this open arcuate portion, the collar fin 656 defines the first edge of the flow, and the deflector fin 694 defines the second edge of the flow. Fluid flows through the open arcuate portion along the notches 686 formed on the lower end of the deflector 680.

Most of the fluid continues flowing upwardly through the nozzle 610. This upwardly-directed fluid strikes the underside 684 of the deflector 680. The cover wall 678 engages the underside 684 of the deflector 680 and is aligned with the collar fin 656 to define the first edge of the water distribution arc. Similarly, the deflector wall 698 is aligned with the deflector fin 694 to define the second edge. Thus, these walls 678 and 698 and fins 656 and 694 extend downstream from the helical valve 691 to guide fluid flow through the primary outlet 616 in accordance with the arcuate span set by the user.

Some of the fluid flowing past the helical valve 691 flows through the tortuous flow passages 676 defined by the combination of the nozzle collar 640 and the cover 660 for close-in irrigation. Fluid flows past the helical valve 691 and then laterally outwardly through the inner channels exposed by the open portion of the valve 691. Fluid flows along the inner channels corresponding to inner grooves 672, then downwardly into the recesses 648, then outwardly in the recesses 648 and around the pins 651, then upwardly into the outer radial channels corresponding to outer grooves 674, and then outwardly from the nozzle 610.

Figure 22:
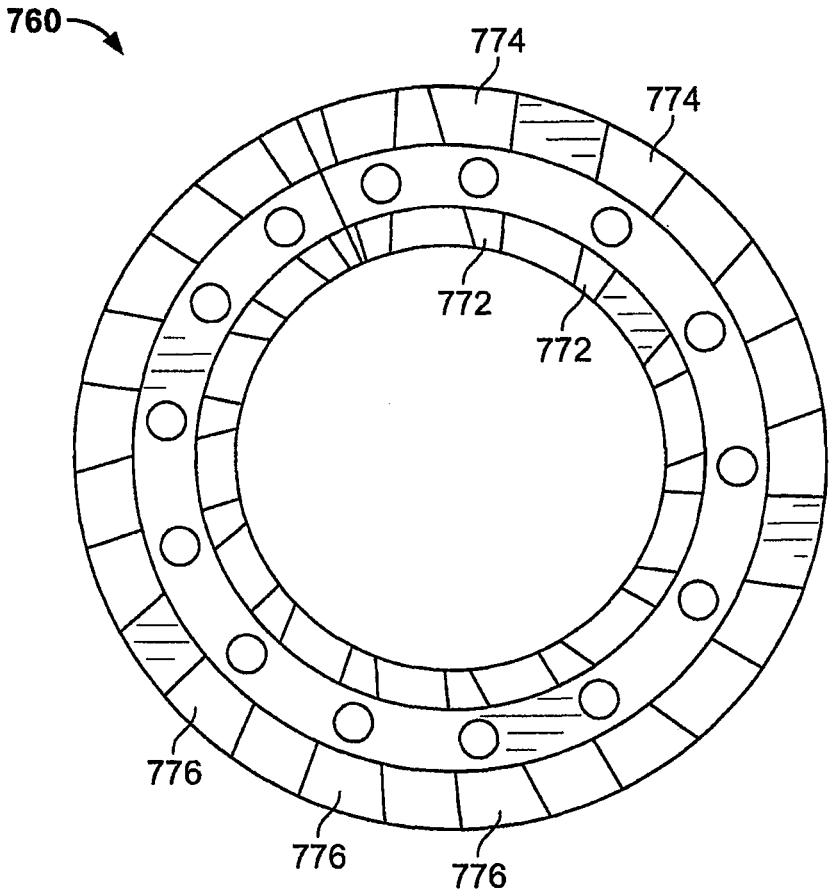
FIG. 22 is a bottom plan view of an alternative preferred embodiment of a cover embodying features of the present invention.

As can be seen in FIG. 22, in one alternative preferred form, the nozzle may include a different number of flow passages and the flow passages need not be oriented radially. For example, an alternative form of the cover 760 may include fourteen inner grooves 772 aligned with fourteen outer grooves 774 to define fourteen flow passages 776 that are each oriented at a slight angle with respect to a radial direction. More specifically, the flow passages 776 are inclined with respect to the radial direction such that fluid is directed inwardly from the first edge defined by the deflector fin 694. In this manner, the nozzle addresses the situation where the deflector fin 694 is positioned so as to partially block one of the inner grooves 772. With radial flow passages 676, this partial position results in fluid potentially being distributed outside of the intended edge of the water distribution arc. In contrast, with the non-radial flow passages 776, fluid is directed slightly inwardly from the intended edge so that all of the emitted fluid remains within the arc, even in this partially unblocked position.

The user rotates the nozzle collar 640 to open and close the helical valve 691, and the deflector fin 694 and collar fin 656 are sized so as not to interfere with such rotation. The deflector fin 694 is sized so as to allow rotation of the central hub 644 of the collar 640 about its edge. In a fully closed position, the deflector fin 694 is adjacent the collar fin 656, and the collar 640 is at its highest position relative to the deflector 680. The cover wall 678 and deflector wall 698 preferably engage at this fully closed position to prevent further rotation and possible damage to fins 656 and 694. In this fully closed position, the helical valve 691 is closed and the innermost radial edge 654 blocks fluid flow to both outlets 616 and 618.

As the user rotates the nozzle collar 640 clockwise, the deflector fin 694 rides along as the central hub 644 rotates until it traverses the entire helix where it is again adjacent the collar fin 656. The collar 640 is now at its lowest position relative to the deflector 680, and this lowest position corresponds to a fully open position. The base threading 633 or the collar threading 643 preferably includes a stop to prevent further rotation of the collar 640 beyond this fully open position and to prevent possible damage to the fins 656 and 694. In this fully open position, the helical valve 691 allows fluid flow to both primary and secondary outlets 616 and 618. In an intermediate open position set by the user, the helical valve 691 controls fluid flow to both outlets 616 and 618 in accordance with the selected arcuate span. The pitch of the base and collar threading 633 and 643 is preferably equivalent to the pitch of the helical engagement surface 644 of the helical valve 691.

The above relationship of the collar 640, cover 660, and deflector 680 is based on the use of a right hand helix. It should be evident that the relationship may be reversed based on the use of components having surfaces forming a left hand helix. In that instance, rotation of the nozzle collar 640 in a counterclockwise manner would cause the collar 640 to advance from a fully closed position to a fully open position.

This form of the variable arc nozzle 610 provides several advantages over other forms. Helical valve 691 controls fluid flow to both outlets 616 and 618. Further, nozzle 610 uses lateral inner flow channels having a relatively large cross-section, rather than relatively small axial openings, and therefore preferably does not include a filter immediately upstream of the secondary outlet 618. Nozzle 610 also does not rely primarily on the tortuous flow passages 676 to reduce fluid pressure. Instead, the arrangement of the flow passages 676 relative to the upwardly directed main flow substantially reduces the fluid pressure. In addition, nozzle 610 involves relatively few components that may be easily assembled.

It will be understood that various changes in the details, materials, and arrangements of parts and components which have been herein described and illustrated in order to explain the nature of the nozzle may be made by those skilled in the art within the principle and scope of the nozzle as expressed in the appended claims. Furthermore, while various features have been described with regard to a particular embodiment or a particular approach, it will be appreciated that features described for one embodiment also may be incorporated with the other described embodiments.

What is claimed is:

1. A variable arc nozzle comprising:

a deflector having an underside surface configured to redirect fluid outwardly therefrom;

a nozzle body having an inlet for receiving fluid from a source, and a helical engagement surface for rotatably engaging the deflector to form a helical valve that forms an arcuate opening adjustable in size from a fully closed position to a desired open position;

a first flow path from the inlet through the helical valve when in an open position exiting the nozzle body to the underside surface of the deflector, the nozzle body and deflector defining a primary irrigation outlet; and a second flow path from the inlet through the helical valve when in an open position to a secondary irrigation outlet formed at the nozzle body, at least a portion of the nozzle body separating the primary irrigation outlet and the secondary irrigation outlet;

wherein the helical valve is configured for matching the precipitation rate of fluid flowing through the valve when in an open position regardless of the size of the arcuate opening;

wherein a stem is disposed upstream of the underside surface and the stem controlling a series of circumferentially spaced flow channels and rotation of the nozzle body in one direction sequentially opening flow channels to allow fluid to flow therethrough in the first and second flow paths and rotation in the opposite direction sequentially closing flow channels to block fluid flow therethrough in the first and second flow paths.

2. The variable arc nozzle of claim 1 wherein at least a portion of the nozzle body is rotatable through at least 180° for causing rotation of the helical engagement surface of the nozzle body with respect to the deflector.

3. A variable arc nozzle comprising:

a deflector having an underside surface configured to redirect fluid outwardly therefrom;

a nozzle body having an inlet for receiving fluid from a source, at least one outlet for directing fluid outwardly from the nozzle, and a helical engagement surface for rotatably engaging the deflector to form a helical valve that forms an arcuate opening adjustable in size from a fully closed position to a desired open position;

a first flow path from the inlet through the helical valve when in an open position to the underside surface of the deflector;

a second flow path from the inlet through the helical valve when in an open position to the at least one outlet;

wherein at least a portion of the nozzle body is rotatable through at least 180° for causing rotation of the helical engagement surface of the nozzle body with respect to the deflector;

wherein the helical valve is configured for matching the precipitation rate of fluid flowing through the valve when in an open position regardless of the size of the arcuate opening; and a stem disposed upstream of the underside surface and the stem controlling a series of circumferentially spaced notches and rotation of the at least a portion of the nozzle body in one direction increasing the number of notches situated in the first and second flow paths and rotation in the opposite direction decreasing the number of notches situated in the first and second flow paths;

wherein the notches extend in an axial direction along the stem and wherein the notches progressively increase in axial length as one proceeds circumferentially about the stem.

4. The variable arc nozzle of claim 1 wherein the nozzle body comprises a first nozzle body portion configured for interlocking engagement with the deflector to hold the deflector fixed with respect to the first nozzle body portion.

5. The variable arc nozzle of claim 4 wherein the first nozzle body portion and the deflector each define a bore, the two bores aligned with one another for insertion of a rotatable member through the first nozzle body portion and the deflector for adjusting the flow rate through the nozzle.

6. A variable arc nozzle comprising:

a deflector having an underside surface configured to redirect fluid outwardly therefrom;

a nozzle body having an inlet for receiving fluid from a source, and a helical engagement surface for rotatably engaging the deflector to form a helical valve that forms an arcuate opening adjustable in size from a fully closed position to a desired open position;

a first flow path from the inlet through the helical valve when in an open position exiting the nozzle body to the underside surface of the deflector, the nozzle body and deflector defining a primary irrigation outlet; and a second flow path from the inlet through the helical valve when in an open position to a secondary irrigation outlet formed at the nozzle body, at least a portion of the nozzle body separating the primary irrigation outlet and the secondary irrigation outlet;

wherein the nozzle body comprises a plurality of second flow paths, a plurality of tortuous flow passages, and a plurality of secondary irrigation outlets, each tortuous flow passage terminating in one of the secondary irrigation outlets.

7. The variable arc nozzle of claim 6 wherein each flow passage includes a flow passage inlet having a first cross-sectional area and a flow passage outlet having a second larger cross-sectional area.

8. The variable arc nozzle of claim 6 wherein at least a portion of the nozzle body is generally cylindrical and the plurality of tortuous flow passages are spaced circumferentially about the at least a portion of the nozzle body.

9. The variable arc nozzle of claim 8 wherein at least one of the tortuous flow passages is oriented in a non-radial direction for directing flow inwardly from a predetermined radial edge corresponding to an open setting of the helical valve.

10. The variable arc nozzle of claim 4 wherein the nozzle body comprises a second nozzle body portion and a third nozzle body portion, the second nozzle body portion comprising a top helical surface for engagement with a corresponding bottom helical surface of the third nozzle body portion.

11. The variable arc nozzle of claim 10 wherein the second nozzle body portion includes a plurality of circumferentially spaced recesses and the third nozzle body portion includes a plurality of circumferentially spaced grooves, the plurality of recesses and grooves configured to define a plurality of tortuous flow passages.

12. A variable arc nozzle comprising:

a deflector having an underside surface configured to redirect fluid outwardly therefrom;

a nozzle body having an inlet for receiving fluid from a source, at least one outlet for directing fluid outwardly from the nozzle, and a helical engagement surface for rotatably engaging the deflector to form a helical valve that forms an arcuate opening adjustable in size from a fully closed position to a desired open position;

a first flow path from the inlet through the helical valve when in an open position to the underside surface of the deflector; and a second flow path from the inlet through the helical valve when in an open position to the at least one outlet;

wherein the nozzle body comprises a plurality of tortuous flow passages therethrough defining the at least one outlet and defining a portion of the second flow path;

wherein the nozzle body comprises a second nozzle body portion and a third nozzle body portion, the second nozzle body portion comprising a top helical surface for engagement with a corresponding bottom helical surface of the third nozzle body portion;

wherein the second nozzle body portion includes a plurality of pins for engagement with a corresponding plurality of apertures of the third nozzle body portion.

13. The variable arc nozzle of claim 1 wherein the nozzle body defines a bore, wherein the deflector comprises a generally cylindrical stem disposed upstream of the underside surface, and wherein the stem is disposed within the bore.

14. The variable arc nozzle of claim 13 wherein the nozzle body includes a fin extending axially and radially and joining ends of the helical engagement surface, the fin configured to engage the deflector to define at least a portion of a first edge of the first flow path.

15. The variable arc nozzle of claim 14 wherein the deflector comprises a fin extending axially along the stem and extending radially outward from the stem, the fin configured to engage the nozzle body to define at least a portion of a second edge of the first flow path.

16. The variable arc nozzle of claim 15 wherein the deflector underside surface is helical with the ends of the helical surface defining a first wall, the first wall aligned with the deflector fin to define at least a portion of the first edge of the first flow path.

17. The variable arc nozzle of claim 16 wherein the nozzle body comprises a helical top surface with the ends of the helical top surface defining a second wall, the second wall aligned with the nozzle body fin to define at least a portion of the second edge of the first flow path.

18. The variable arc nozzle of claim 17 wherein the first wall and the second wall are configured to engage one another to limit rotation of the at least a portion of the nozzle body beyond a predetermined position.

19. The variable arc nozzle of claim 1 wherein the valve is configured to proportion the amount of fluid flowing through the valve such that a first amount of fluid flows through the valve when in a first arcuate size and such that a multiple of this first amount of fluid flows through the valve when the valve size is increased or decreased by this multiple.

20. The variable arc nozzle of claim 1 further comprising:

a plurality of flow channels that may be opened to allow fluid to flow therethrough and that may be closed to prevent fluid from flowing therethrough;

wherein the nozzle body is adjustable to open a predetermined number of flow channels corresponding to the size of the arcuate opening to proportion the amount of fluid flowing through the valve to match the precipitation rate for different arcuate opening sizes.

* * * * *